US010722779B2

(12) United States Patent
Blaha et al.

(10) Patent No.: US 10,722,779 B2
(45) **Date of Patent: *Jul. 28, 2020**

(54) METHODS OF OPERATING CARD HANDLING DEVICES OF CARD HANDLING SYSTEMS

(71) Applicant: Shuffle Master GmbH & Co KG, Vienna (AT)

(72) Inventors: Ernst Blaha, Tullnerbach (AT); Peter Krenn, Neufeld (AT); Todd M. Haushalter, Las Vegas, NV (US)

(73) Assignee: Shuffle Master GmbH & Co KG, Vienna (AT)

( * ) Notice: Subject to any disclaimer, the term of this patent is extended or adjusted under 35 U.S.C. 154(b) by 174 days.

This patent is subject to a terminal disclaimer.

(21) Appl. No.: 15/792,467

(22) Filed: Oct. 24, 2017

(65) Prior Publication Data

US 2018/0043241 A1 Feb. 15, 2018

Related U.S. Application Data

(62) Division of application No. 14/456,733, filed on Aug. 11, 2014, now Pat. No. 9,802,114, which is a division of application No. 13/270,109, filed on Oct. 10, 2011, now Pat. No. 8,800,993.

(60) Provisional application No. 61/393,299, filed on Oct. 14, 2010.

(51) Int. Cl.
*A63F 1/12* (2006.01)

(52) U.S. Cl.
CPC ..... *A63F 1/12* (2013.01)

(58) Field of Classification Search
CPC ..... A63F 1/12
(Continued)

(56) References Cited

U.S. PATENT DOCUMENTS 130,281 A 8/1872 Coughlin
205,030 A 6/1878 Ash
(Continued)

FOREIGN PATENT DOCUMENTS

AU 2383667 A 1/1969
AU 5025479 A1 3/1980
(Continued)

OTHER PUBLICATIONS

13 B/W CCD Camera Module EB100 by EverFocus Electronics Corp., Jul. 31, 2001, 3 pgs.
(Continued)

*Primary Examiner* — John E Simms, Jr.
*Assistant Examiner* — Dolores R Collins
(74) *Attorney, Agent, or Firm* — TraskBritt

(57) ABSTRACT

Card handling systems include shuffling devices, shoe devices, and a card transfer system for automatically transferring cards from the shuffling device into the shoe device. Shuffling devices may include a divider configured to contact at least one card positioned within a compartment of the shuffling device. Shoe devices may include a card loading system for loading cards into a card storage area through an opening in a base of the shoe device. Methods of providing cards during a casino table game play include identifying card information including a rank and a suit of each card in a shuffling device and a shoe device and transporting cards from the shuffling device to the shoe device.

20 Claims, 5 Drawing Sheets

(58) Field of Classification Search
USPC ..... 273/149 R
See application file for complete search history.

(56) References Cited

U.S. PATENT DOCUMENTS

| | | | |
|---|---|---|---|
| 609,730 | A | 8/1898 | Booth |
| 673,154 | A | 4/1901 | Bellows |
| 793,489 | A | 6/1905 | Williams |
| 892,389 | A | 7/1908 | Bellows |
| 1,014,219 | A | 1/1912 | Hall |
| 1,043,109 | A | 11/1912 | Hurm |
| 1,157,898 | A | 10/1915 | Perret |
| 1,256,509 | A | 2/1918 | Belknap |
| 1,380,898 | A | 6/1921 | Hall |
| 1,992,085 | A | 2/1925 | McKay |
| 1,556,856 | A | 10/1925 | Lipps |
| 1,850,114 | A | 6/1929 | McCaddin |
| 1,757,553 | A | 5/1930 | Gustav |
| 1,885,276 | A | 11/1932 | McKay |
| 1,889,729 | A | 11/1932 | Hammond |
| 1,955,926 | A | 4/1934 | Matthaey |
| 1,998,690 | A | 4/1935 | Shepherd et al. |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,060,096 | A | 11/1936 | McCoy |
| 2,065,824 | A | 12/1936 | Plass |
| 2,159,958 | A | 5/1939 | Sachs |
| 2,185,474 | A | 1/1940 | Nott |
| 2,254,484 | A | 9/1941 | Hutchins |
| D132,360 | S | 5/1942 | Gardner |
| 2,328,153 | A | 8/1943 | Laing |
| 2,328,879 | A | 9/1943 | Isaacson |
| D139,530 | S | 11/1944 | Schindler |
| 2,364,413 | A | 12/1944 | Wittel |
| 2,525,305 | A | 10/1950 | Lombard |
| 2,543,522 | A | 2/1951 | Cohen |
| 2,588,582 | A | 3/1952 | Sivertson |
| 2,615,719 | A | 10/1952 | Fonken |
| 2,659,607 | A | 11/1953 | Skillman et al. |
| 2,661,215 | A | 12/1953 | Stevens |
| 2,676,020 | A | 4/1954 | Ogden |
| 2,692,777 | A | 10/1954 | Miller |
| 2,701,720 | A | 2/1955 | Ogden |
| 2,705,638 | A | 4/1955 | Newcomb |
| 2,711,319 | A | 6/1955 | Morgan et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,731,271 | A | 1/1956 | Brown |
| 2,747,877 | A | 5/1956 | Howard |
| 2,755,090 | A | 7/1956 | Aldrich |
| 2,757,005 | A | 7/1956 | Nothaft |
| 2,760,779 | A | 8/1956 | Ogden et al. |
| 2,770,459 | A | 11/1956 | Wilson et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Liebelt |
| 2,815,214 | A | 12/1957 | Hall |
| 2,821,399 | A | 1/1958 | Heinoo |
| 2,914,215 | A | 11/1959 | Neidig |
| 2,937,739 | A | 5/1960 | Levy |
| 2,950,005 | A | 8/1960 | MacDonald |
| RE24,986 | E | 5/1961 | Stephenson |
| 3,067,885 | A | 12/1962 | Kohler |
| 3,107,096 | A | 10/1963 | Osborn |
| 3,124,674 | A | 3/1964 | Edwards et al. |
| 3,131,935 | A | 5/1964 | Gronneberg |
| 3,147,978 | A | 9/1964 | Sjostrand |
| D200,652 | S | 3/1965 | Fisk |
| 3,185,482 | A | 5/1965 | Russell |
| 3,222,071 | A | 12/1965 | Lang |
| 3,235,741 | A | 2/1966 | Plaisance |
| 3,288,308 | A | 11/1966 | Gingher |
| 3,305,237 | A | 2/1967 | Granius |
| 3,312,473 | A | 4/1967 | Friedman et al. |
| 3,452,509 | A | 7/1969 | Hauer |
| 3,530,968 | A | 9/1970 | Palmer |
| 3,588,116 | A | 6/1971 | Miura |
| 3,589,730 | A | 6/1971 | Slay |
| 3,595,388 | A | 7/1971 | Castaldi |
| 3,597,076 | A | 8/1971 | Hubbard et al. |
| 3,598,396 | A | 8/1971 | Andrews et al. |
| 3,618,933 | A | 11/1971 | Roggenstein et al. |
| 3,627,331 | A | 12/1971 | Lyon, Jr. |
| 3,666,270 | A | 5/1972 | Mazur |
| 3,680,853 | A | 8/1972 | Houghton et al. |
| 3,690,670 | A | 9/1972 | Cassady et al. |
| 3,704,938 | A | 12/1972 | Fanselow |
| 3,716,238 | A | 2/1973 | Porter |
| 3,751,041 | A | 8/1973 | Seifert |
| 3,761,079 | A | 9/1973 | Azure, Jr. |
| 3,810,627 | A | 5/1974 | Levy |
| D232,953 | S | 9/1974 | Oguchi |
| 3,861,261 | A | 1/1975 | Maxey |
| 3,897,954 | A | 8/1975 | Erickson et al. |
| 3,899,178 | A | 8/1975 | Watanabe |
| 3,909,002 | A | 9/1975 | Levy |
| 3,929,339 | A | 12/1975 | Mattioli |
| 3,944,077 | A | 3/1976 | Green |
| 3,944,230 | A | 3/1976 | Fineman |
| 3,949,219 | A | 4/1976 | Crouse |
| 3,968,364 | A | 7/1976 | Miller |
| 4,023,705 | A | 5/1977 | Reiner et al. |
| 4,033,590 | A | 7/1977 | Pic |
| 4,072,930 | A | 2/1978 | Lucero et al. |
| 4,088,265 | A | 5/1978 | Garczynski |
| 4,151,410 | A | 4/1979 | McMillan et al. |
| 4,159,581 | A | 7/1979 | Lichtenberg |
| 4,162,649 | A | 7/1979 | Thornton |
| 4,166,615 | A | 9/1979 | Noguchi et al. |
| 4,232,861 | A | 11/1980 | Maul |
| 4,280,690 | A | 7/1981 | Hill |
| 4,283,709 | A | 8/1981 | Lucero et al. |
| 4,310,160 | A | 1/1982 | Willette et al. |
| 4,339,134 | A | 7/1982 | Macheel |
| 4,339,798 | A | 7/1982 | Hedges et al. |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,377,285 | A | 3/1983 | Kadlic |
| 4,385,827 | A | 5/1983 | Naramore |
| 4,388,994 | A | 6/1983 | Suda et al. |
| 4,397,469 | A | 8/1983 | Carter, III |
| 4,421,312 | A | 12/1983 | Delgado et al. |
| 4,421,501 | A | 12/1983 | Scheffer |
| D273,962 | S | 5/1984 | Fromm |
| D274,069 | S | 5/1984 | Fromm |
| 4,457,512 | A | 7/1984 | Stevenson |
| 4,467,424 | A | 8/1984 | Hedges et al. |
| 4,494,197 | A | 1/1985 | Troy et al. |
| 4,497,488 | A | 2/1985 | Plevyak et al. |
| 4,512,580 | A | 4/1985 | Matviak |
| 4,513,969 | A | 4/1985 | Samsel, Jr. |
| 4,515,367 | A | 5/1985 | Howard |
| 4,531,187 | A | 7/1985 | Uhland |
| 4,534,562 | A | 8/1985 | Cuff et al. |
| 4,549,738 | A | 10/1985 | Greitzer |
| 4,566,782 | A | 1/1986 | Britt et al. |
| 4,575,367 | A | 3/1986 | Karmel |
| 4,586,712 | A | 5/1986 | Loiter et al. |
| 4,659,082 | A | 4/1987 | Greenberg |
| 4,662,637 | A | 5/1987 | Pfeiffer |
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,412 | A | 9/1988 | Wolfe |

(56) References Cited

U.S. PATENT DOCUMENTS 4,770,421 A 9/1988 Hoffman
4,807,884 A 2/1989 Breeding
4,822,050 A 4/1989 Normand et al.
4,832,342 A 5/1989 Plevyak et al.
4,858,000 A 8/1989 Lu
4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.
4,926,327 A 5/1990 Sidley
4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng
5,000,453 A 3/1991 Stevens et al.
5,004,218 A 4/1991 Sardano et al.
5,039,102 A 8/1991 Miller
5,067,713 A 11/1991 Soules et al.
5,078,405 A 1/1992 Jones et al.
5,081,487 A 1/1992 Royer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 LeVasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 DeMar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A * 1/1995 Blaha ..... A63F 1/12 273/149 R
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 LeStrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A * 12/1996 Sines ..... A63F 1/12 273/149 R
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Garner
5,690,324 A 11/1997 Otomo et al.
5,692,748 A 12/1997 Frisco et al.
5,695,189 A 12/1997 Breeding et al.
5,695,489 A * 12/1997 Japuntich ..... A61M 1/3627 604/403
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 van Putten et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson
5,836,775 A 11/1998 Hiyama et al.
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky
5,941,769 A 8/1999 Order
5,944,310 A * 8/1999 Johnson ..... A63F 1/12 273/149 R
D414,527 S 9/1999 Tedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea, Jr.
6,113,101 A 9/2000 Wirth
6,117,012 A 9/2000 McCrea, Jr.

(56) References Cited

U.S. PATENT DOCUMENTS

D432,588 S 10/2000 Tedham
6,126,166 A 10/2000 Lorson et al.
6,131,817 A 10/2000 Miller
6,139,014 A 10/2000 Breeding et al.
6,149,154 A 11/2000 Grauzer et al.
6,154,131 A 11/2000 Jones, II et al.
6,165,069 A 12/2000 Sines et al.
6,165,072 A 12/2000 Davis et al.
6,183,362 B1 2/2001 Boushy
6,186,895 B1 2/2001 Oliver
6,196,416 B1 3/2001 Seagle
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht
6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Hessing et al.
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block
6,386,973 B1 5/2002 Yoseloff
6,402,142 B1 6/2002 Warren et al.
6,403,908 B2 6/2002 Stardust et al.
6,443,839 B2 9/2002 Stockdale et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,561,897 B1 5/2003 Bourbour et al.
6,568,678 B2 5/2003 Breeding et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hard
6,585,856 B2 7/2003 Zwick et al.
6,588,750 B1 7/2003 Grauzer et al.
6,588,751 B1 7/2003 Grauzer et al.
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson et al.
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,655,690 B1 12/2003 Oskwarek
6,658,135 B1 12/2003 Morito et al.
6,659,460 B2 12/2003 Blaha et al.
6,659,461 B2 12/2003 Yoseloff
6,659,875 B2 12/2003 Purton
6,663,490 B2 12/2003 Soltys et al.
6,666,768 B1 12/2003 Akers
6,671,358 B1 12/2003 Seidman et al.
6,676,127 B2 1/2004 Johnson et al.
6,676,517 B2 1/2004 Beavers
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 * 3/2004 Baker ..... A63F 1/12
273/149 R
6,698,759 B2 3/2004 Webb et al.
6,702,289 B1 3/2004 Feola
6,702,290 B2 3/2004 Buono-Correa et al.
6,709,333 B1 3/2004 Bradford et al.
6,712,696 B2 3/2004 Soltys et al.
6,719,288 B2 4/2004 Hessing et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,749,510 B2 6/2004 Giobbi
6,758,751 B2 7/2004 Soltys et al.
6,758,757 B2 7/2004 Luciano, Jr. et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow et al.
6,842,263 B1 1/2005 Saeki
6,843,725 B2 1/2005 Nelson
6,848,616 B2 2/2005 Tsirline et al.
6,848,844 B2 2/2005 McCue, Jr. et al.
6,848,994 B1 2/2005 Knust et al.
6,857,961 B2 2/2005 Soltys et al.
6,874,784 B1 4/2005 Promutico et al.
6,874,786 B2 4/2005 Bruno
6,877,657 B2 4/2005 Ranard et al.
6,877,748 B1 4/2005 Patroni et al.
6,886,829 B2 5/2005 Hessing et al.
6,889,979 B2 5/2005 Blaha et al.
6,893,347 B1 5/2005 Zilliacus et al.
6,899,628 B2 5/2005 Leen et al.
6,902,167 B2 6/2005 Webb
6,905,121 B1 6/2005 Timpano
6,923,446 B2 8/2005 Snow

(56) References Cited

U.S. PATENT DOCUMENTS

| | | | | |
|---|---|---|---|---|
| 6,938,900 | B2 | 9/2005 | Snow | |
| 6,941,180 | B1 | 9/2005 | Fisher et al. | |
| 6,950,948 | B2 | 9/2005 | Neff | |
| 6,955,599 | B2 | 10/2005 | Bourbour et al. | |
| 6,957,746 | B2 | 10/2005 | Martin et al. | |
| 6,959,925 | B1 * | 11/2005 | Baker | A63F 1/12 273/149 R |
| 6,960,134 | B2 | 11/2005 | Hartl et al. | |
| 6,964,612 | B2 | 11/2005 | Soltys et al. | |
| 6,986,514 | B2 | 1/2006 | Snow | |
| 6,988,516 | B2 | 1/2006 | Debaes | |
| 7,011,309 | B2 | 3/2006 | Soltys et al. | |
| 7,020,307 | B2 | 3/2006 | Hinton et al. | |
| 7,028,598 | B2 | 4/2006 | Teshima | |
| 7,029,009 | B2 | 4/2006 | Grauzer et al. | |
| 7,036,818 | B2 | 5/2006 | Grauzer et al. | |
| 7,046,458 | B2 | 5/2006 | Nakayama | |
| 7,046,764 | B1 | 5/2006 | Kump | |
| 7,048,629 | B2 | 5/2006 | Sines et al. | |
| 7,059,602 | B2 | 6/2006 | Grauzer et al. | |
| 7,066,464 | B2 | 6/2006 | Blad et al. | |
| 7,068,822 | B2 | 6/2006 | Scott | |
| 7,073,791 | B2 | 7/2006 | Grauzer et al. | |
| 7,079,010 | B2 | 7/2006 | Champlin | |
| 7,084,769 | B2 | 8/2006 | Bauer et al. | |
| 7,089,420 | B1 | 8/2006 | Durst et al. | |
| D527,900 | S | 9/2006 | Dewa | |
| 7,106,201 | B2 | 9/2006 | Tuttle | |
| 7,113,094 | B2 | 9/2006 | Garber et al. | |
| 7,114,718 | B2 | 10/2006 | Grauzer et al. | |
| 7,124,947 | B2 | 10/2006 | Storch | |
| 7,128,652 | B1 | 10/2006 | Lavoie et al. | |
| 7,137,627 | B2 | 11/2006 | Grauzer et al. | |
| 7,139,108 | B2 | 11/2006 | Andersen et al. | |
| 7,140,614 | B2 | 11/2006 | Snow | |
| 7,162,035 | B1 | 1/2007 | Durst et al. | |
| 7,165,769 | B2 | 1/2007 | Crenshaw et al. | |
| 7,165,770 | B2 | 1/2007 | Snow | |
| 7,175,522 | B2 | 2/2007 | Hartl | |
| 7,186,181 | B2 | 3/2007 | Rowe | |
| 7,201,656 | B2 | 4/2007 | Darder | |
| 7,202,888 | B2 | 4/2007 | Tecu et al. | |
| 7,203,841 | B2 | 4/2007 | Jackson et al. | |
| 7,213,812 | B2 | 5/2007 | Schubert | |
| 7,222,852 | B2 | 5/2007 | Soltys | |
| 7,222,855 | B2 | 5/2007 | Sorge | |
| 7,231,812 | B1 | 6/2007 | Lagare | |
| 7,234,698 | B2 | 6/2007 | Grauzer et al. | |
| 7,237,969 | B2 | 7/2007 | Bartman | |
| 7,243,148 | B2 | 7/2007 | Keir et al. | |
| 7,243,698 | B2 | 7/2007 | Siegel | |
| 7,246,799 | B2 | 7/2007 | Snow | |
| 7,255,344 | B2 | 8/2007 | Grauzer et al. | |
| 7,255,351 | B2 | 8/2007 | Yoseloff et al. | |
| 7,255,642 | B2 | 8/2007 | Sines et al. | |
| 7,257,630 | B2 | 8/2007 | Cole et al. | |
| 7,261,294 | B2 | 8/2007 | Grauzer et al. | |
| 7,264,241 | B2 | 9/2007 | Schubert et al. | |
| 7,264,243 | B2 | 9/2007 | Yoseloff et al. | |
| 7,277,570 | B2 | 10/2007 | Armstrong | |
| 7,278,923 | B2 | 10/2007 | Grauzer et al. | |
| 7,294,056 | B2 | 11/2007 | Lowell et al. | |
| 7,297,062 | B2 | 11/2007 | Gatto et al. | |
| 7,300,056 | B2 | 11/2007 | Gioia et al. | |
| 7,303,473 | B2 | 12/2007 | Rowe | |
| 7,303,475 | B2 | 12/2007 | Britt et al. | |
| 7,309,065 | B2 | 12/2007 | Yoseloff et al. | |
| 7,316,609 | B2 | 1/2008 | Dunn et al. | |
| 7,316,615 | B2 | 1/2008 | Soltys et al. | |
| 7,322,576 | B2 | 1/2008 | Grauzer et al. | |
| 7,331,579 | B2 | 2/2008 | Snow | |
| 7,334,794 | B2 | 2/2008 | Snow | |
| 7,338,044 | B2 | 3/2008 | Grauzer et al. | |
| 7,338,362 | B1 | 3/2008 | Gallagher | |
| 7,341,510 | B2 | 3/2008 | Bourbour et al. | |
| D566,784 | S | 4/2008 | Palmer | |
| 7,357,321 | B2 | 4/2008 | Yoshida | |
| 7,360,094 | B2 | 4/2008 | Neff | |
| 7,367,561 | B2 | 5/2008 | Blaha et al. | |
| 7,367,563 | B2 | 5/2008 | Yoseloff et al. | |
| 7,367,565 | B2 | 5/2008 | Chiu | |
| 7,367,884 | B2 | 5/2008 | Breeding et al. | |
| 7,374,170 | B2 | 5/2008 | Grauzer et al. | |
| 7,384,044 | B2 | 6/2008 | Grauzer et al. | |
| 7,387,300 | B2 | 6/2008 | Snow | |
| 7,389,990 | B2 | 6/2008 | Mourad | |
| 7,390,256 | B2 | 6/2008 | Soltys et al. | |
| 7,399,226 | B2 | 7/2008 | Mishra | |
| 7,407,438 | B2 | 8/2008 | Schubert et al. | |
| 7,413,191 | B2 | 8/2008 | Grauzer et al. | |
| 7,434,805 | B2 | 10/2008 | Grauzer et al. | |
| 7,436,957 | B1 | 10/2008 | Fisher et al. | |
| 7,448,626 | B2 | 11/2008 | Fleckenstein | |
| 7,458,582 | B2 | 12/2008 | Snow et al. | |
| 7,461,843 | B1 | 12/2008 | Baker et al. | |
| 7,464,932 | B2 | 12/2008 | Darling | |
| 7,464,934 | B2 | 12/2008 | Schwartz | |
| 7,472,906 | B2 | 1/2009 | Shai | |
| 7,478,813 | B1 | 1/2009 | Hofferber et al. | |
| 7,500,672 | B2 | 3/2009 | Ho | |
| 7,506,874 | B2 | 3/2009 | Hall | |
| 7,510,186 | B2 | 3/2009 | Fleckenstein | |
| 7,510,190 | B2 | 3/2009 | Snow et al. | |
| 7,510,194 | B2 | 3/2009 | Soltys et al. | |
| 7,510,478 | B2 | 3/2009 | Benbrahim et al. | |
| 7,513,437 | B2 | 4/2009 | Douglas | |
| 7,515,718 | B2 | 4/2009 | Nguyen et al. | |
| 7,523,935 | B2 | 4/2009 | Grauzer et al. | |
| 7,523,936 | B2 | 4/2009 | Grauzer et al. | |
| 7,523,937 | B2 | 4/2009 | Fleckenstein | |
| 7,525,510 | B2 | 4/2009 | Beland et al. | |
| 7,537,216 | B2 | 5/2009 | Soltys et al. | |
| 7,540,497 | B2 | 6/2009 | Tseng | |
| 7,540,498 | B2 | 6/2009 | Crenshaw et al. | |
| 7,549,643 | B2 | 6/2009 | Quach | |
| 7,554,753 | B2 | 6/2009 | Wakamiya | |
| 7,556,197 | B2 | 7/2009 | Yoshida | |
| 7,556,266 | B2 | 7/2009 | Blaha et al. | |
| 7,575,237 | B2 | 8/2009 | Snow | |
| 7,578,506 | B2 | 8/2009 | Lambert | |
| 7,584,962 | B2 | 9/2009 | Breeding et al. | |
| 7,584,963 | B2 | 9/2009 | Krenn et al. | |
| 7,584,966 | B2 | 9/2009 | Snow | |
| 7,591,728 | B2 | 9/2009 | Gioia et al. | |
| 7,593,544 | B2 | 9/2009 | Downs | |
| 7,594,660 | B2 | 9/2009 | Baker et al. | |
| 7,597,623 | B2 | 10/2009 | Grauzer et al. | |
| 7,644,923 | B1 | 1/2010 | Dickinson et al. | |
| 7,661,676 | B2 | 2/2010 | Smith et al. | |
| 7,666,090 | B2 | 2/2010 | Hettinger | |
| 7,669,852 | B2 | 3/2010 | Baker et al. | |
| 7,669,853 | B2 | 3/2010 | Jones | |
| 7,677,565 | B2 | 3/2010 | Grauzer et al. | |
| 7,677,566 | B2 | 3/2010 | Krenn et al. | |
| 7,686,681 | B2 | 3/2010 | Soltys et al. | |
| 7,699,694 | B2 | 4/2010 | Hill | |
| 7,735,657 | B2 | 6/2010 | Johnson | |
| 7,740,244 | B2 | 6/2010 | Ho | |
| 7,744,452 | B2 | 6/2010 | Cimring et al. | |
| 7,753,373 | B2 | 7/2010 | Grauzer et al. | |
| 7,753,374 | B2 | 7/2010 | Ho | |
| 7,753,798 | B2 | 7/2010 | Soltys | |
| 7,758,425 | B2 | 7/2010 | Poh et al. | |
| 7,762,554 | B2 | 7/2010 | Ho | |
| 7,764,836 | B2 | 7/2010 | Downs et al. | |
| 7,766,332 | B2 | 8/2010 | Grauzer et al. | |
| 7,766,333 | B1 | 8/2010 | Stardust | |
| 7,769,232 | B2 | 8/2010 | Downs, III | |
| 7,769,853 | B2 | 8/2010 | Nezamzadeh | |
| 7,773,749 | B1 | 8/2010 | Durst et al. | |
| 7,780,529 | B2 | 8/2010 | Rowe et al. | |
| 7,784,790 | B2 | 8/2010 | Grauzer et al. | |
| 7,804,982 | B2 | 9/2010 | Howard et al. | |
| 7,824,255 | B2 | 11/2010 | Lutnick | |

(56) References Cited

U.S. PATENT DOCUMENTS 7,846,020 B2 12/2010 Walker et al.
7,867,080 B2 1/2011 Nicely et al.
7,890,365 B2 2/2011 Hettinger
7,900,923 B2 3/2011 Toyama et al.
7,901,285 B2 3/2011 Tran et al.
7,908,169 B2 3/2011 Hettinger
7,909,689 B2 3/2011 Lardie
7,931,533 B2 4/2011 LeMay et al.
7,933,448 B2 4/2011 Downs, III
7,946,586 B2 5/2011 Krenn et al.
7,959,153 B2 6/2011 Franks, Jr.
7,967,294 B2 6/2011 Blaha et al.
7,976,023 B1 7/2011 Hessing et al.
7,988,152 B2 8/2011 Sines et al.
7,988,554 B2 8/2011 LeMay et al.
7,995,196 B1 8/2011 Fraser
8,002,638 B2 8/2011 Grauzer et al.
8,011,661 B2 9/2011 Stasson
8,016,663 B2 9/2011 Soltys et al.
8,021,231 B2 9/2011 Walker et al.
8,025,294 B2 9/2011 Grauzer et al.
8,038,521 B2 10/2011 Grauzer et al.
RE42,944 E 11/2011 Blaha et al.
8,057,302 B2 11/2011 Wells et al.
8,062,134 B2 11/2011 Kelly et al.
8,070,574 B2 12/2011 Grauzer et al.
8,092,307 B2 1/2012 Kelly
8,092,309 B2 1/2012 Bickley
8,109,514 B2 2/2012 Toyama
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 1/2013 Scheper et al.
8,342,526 B1 1/2013 Sampson
8,342,529 B2 1/2013 Snow
8,353,513 B2 1/2013 Swanson
8,381,918 B2 2/2013 Johnson
8,419,521 B2 4/2013 Grauzer et al.
8,429,229 B2 4/2013 Sepich et al.
8,444,147 B2 5/2013 Grauzer et al.
8,444,489 B2 5/2013 Lian et al.
8,469,360 B2 6/2013 Sines
8,475,252 B2 7/2013 Savage et al.
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,550,464 B2 10/2013 Soltys et al.
8,556,263 B2 10/2013 Grauzer et al.
8,579,289 B2 11/2013 Rynda et al.
8,602,416 B2 12/2013 Toyama
8,616,552 B2 12/2013 Czyzewski et al.
8,628,086 B2 1/2014 Krenn et al.
8,651,485 B2 2/2014 Stasson
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,820,745 B2 9/2014 Grauzer et al.
8,844,930 B2 9/2014 Sampson
8,899,587 B2 12/2014 Grauzer et al.
8,919,775 B2 12/2014 Wadds et al.
9,101,821 B2 8/2015 Snow
9,251,661 B2 2/2016 Tammesoo
9,266,012 B2 2/2016 Grauzer
9,280,866 B2 3/2016 Nayak et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,679,603 B2 6/2017 Kelly et al.
9,731,190 B2 8/2017 Sampson et al.
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 4/2003 Blaha et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0023752 A1 2/2005 Grauzer et al.
2005/0026680 A1 2/2005 Gururajan
2005/0035548 A1 2/2005 Yoseloff
2005/0037843 A1 2/2005 Wells et al.
2005/0040594 A1 2/2005 Krenn et al.
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.
2005/0110210 A1 5/2005 Soltys et al.

(56) References Cited

U.S. PATENT DOCUMENTS

| | | | |
|---|---|---|---|
| 2005/0113166 | A1 | 5/2005 | Grauzer et al. |
| 2005/0113171 | A1 | 5/2005 | Hodgson |
| 2005/0119048 | A1 | 6/2005 | Soltys |
| 2005/0121852 | A1 | 6/2005 | Soltys et al. |
| 2005/0137005 | A1 | 6/2005 | Soltys et al. |
| 2005/0140090 | A1 | 6/2005 | Breeding et al. |
| 2005/0146093 | A1 | 7/2005 | Grauzer et al. |
| 2005/0148391 | A1 | 7/2005 | Tain |
| 2005/0164759 | A1 | 7/2005 | Smith et al. |
| 2005/0164761 | A1 | 7/2005 | Tain |
| 2005/0192092 | A1 | 9/2005 | Breckner et al. |
| 2005/0206077 | A1 | 9/2005 | Grauzer et al. |
| 2005/0242500 | A1 | 11/2005 | Downs |
| 2005/0272501 | A1 | 12/2005 | Tran et al. |
| 2005/0277463 | A1 | 12/2005 | Knust et al. |
| 2005/0288083 | A1 | 12/2005 | Downs |
| 2005/0288086 | A1 | 12/2005 | Schubert et al. |
| 2006/0027970 | A1 | 2/2006 | Kyrychenko |
| 2006/0033269 | A1 | 2/2006 | Grauzer et al. |
| 2006/0033270 | A1 | 2/2006 | Grauzer et al. |
| 2006/0046853 | A1 | 3/2006 | Black |
| 2006/0063577 | A1 | 3/2006 | Downs, III et al. |
| 2006/0066048 | A1 | 3/2006 | Krenn et al. |
| 2006/0084502 | A1 | 4/2006 | Downs et al. |
| 2006/0151946 | A1 | 7/2006 | Ngai |
| 2006/0181022 | A1 | 8/2006 | Grauzer et al. |
| 2006/0183540 | A1 | 8/2006 | Grauzer et al. |
| 2006/0189381 | A1 | 8/2006 | Daniel et al. |
| 2006/0199649 | A1 | 9/2006 | Soltys et al. |
| 2006/0205508 | A1 | 9/2006 | Green |
| 2006/0220312 | A1 | 10/2006 | Baker et al. |
| 2006/0220313 | A1 | 10/2006 | Baker et al. |
| 2006/0252521 | A1 | 11/2006 | Gururajan et al. |
| 2006/0252554 | A1 | 11/2006 | Gururajan et al. |
| 2006/0279040 | A1 | 12/2006 | Downs et al. |
| 2006/0281534 | A1 | 12/2006 | Grauzer et al. |
| 2007/0001395 | A1 | 1/2007 | Gioia et al. |
| 2007/0006708 | A1 | 1/2007 | Laakso |
| 2007/0015583 | A1 | 1/2007 | Tran |
| 2007/0018389 | A1 | 1/2007 | Downs, III |
| 2007/0045959 | A1 | 3/2007 | Soltys |
| 2007/0049368 | A1 | 3/2007 | Kuhn et al. |
| 2007/0057454 | A1 | 3/2007 | Fleckenstein |
| 2007/0057469 | A1 | 3/2007 | Grauzer et al. |
| 2007/0066387 | A1 | 3/2007 | Matsuno et al. |
| 2007/0069462 | A1 | 3/2007 | Downs, III et al. |
| 2007/0072677 | A1 | 3/2007 | Lavoie et al. |
| 2007/0102879 | A1 | 5/2007 | Stasson |
| 2007/0111773 | A1 | 5/2007 | Gururajan et al. |
| 2007/0184905 | A1 | 8/2007 | Gatto et al. |
| 2007/0197294 | A1 | 8/2007 | Gong |
| 2007/0197298 | A1 | 8/2007 | Rowe |
| 2007/0202941 | A1 | 8/2007 | Miltenberger et al. |
| 2007/0222147 | A1 | 9/2007 | Blaha et al. |
| 2007/0225055 | A1 | 9/2007 | Weisman |
| 2007/0233567 | A1 | 10/2007 | Daly |
| 2007/0238506 | A1 | 10/2007 | Ruckle |
| 2007/0241498 | A1 | 10/2007 | Soltys |
| 2007/0259709 | A1 | 11/2007 | Kelly et al. |
| 2007/0267812 | A1 | 11/2007 | Grauzer et al. |
| 2007/0272600 | A1 | 11/2007 | Johnson |
| 2007/0278739 | A1 | 12/2007 | Swanson |
| 2007/0287534 | A1 | 12/2007 | Fleckenstein |
| 2007/0290438 | A1 | 12/2007 | Grauzer et al. |
| 2007/0298865 | A1 | 12/2007 | Soltys |
| 2008/0004107 | A1 | 1/2008 | Nguyen et al. |
| 2008/0006997 | A1 | 1/2008 | Scheper et al. |
| 2008/0006998 | A1 | 1/2008 | Grauzer et al. |
| 2008/0022415 | A1 | 1/2008 | Kuo et al. |
| 2008/0032763 | A1 | 2/2008 | Giobbi |
| 2008/0039192 | A1 | 2/2008 | Laut |
| 2008/0039208 | A1 | 2/2008 | Abrink et al. |
| 2008/0096656 | A1 | 4/2008 | LeMay et al. |
| 2008/0111300 | A1 | 5/2008 | Czyzewski et al. |
| 2008/0113700 | A1 | 5/2008 | Czyzewski et al. |
| 2008/0113783 | A1 | 5/2008 | Czyzewski et al. |
| 2008/0136108 | A1 | 6/2008 | Polay |
| 2008/0143048 | A1 | 6/2008 | Shigeta |
| 2008/0176627 | A1 | 7/2008 | Lardie |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0303210 | A1 | 12/2008 | Grauzer et al. |
| 2008/0315517 | A1 | 12/2008 | Toyama et al. |
| 2009/0026700 | A2 | 1/2009 | Shigeta |
| 2009/0048026 | A1 | 2/2009 | French |
| 2009/0054161 | A1 | 2/2009 | Schuber et al. |
| 2009/0072477 | A1 | 3/2009 | Tseng et al. |
| 2009/0121429 | A1 | 3/2009 | Walsh et al. |
| 2009/0091078 | A1 | 4/2009 | Grauzer et al. |
| 2009/0100409 | A1 | 4/2009 | Toneguzzo |
| 2009/0104963 | A1 | 4/2009 | Burman |
| 2009/0134575 | A1 | 5/2009 | Dickinson et al. |
| 2009/0140492 | A1 | 6/2009 | Yoseloff et al. |
| 2009/0166970 | A1 | 7/2009 | Rosh et al. |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0189346 | A1 | 7/2009 | Krenn et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267296 | A1 | 10/2009 | Ho et al. |
| 2009/0267297 | A1 | 10/2009 | Blaha et al. |
| 2009/0283969 | A1 | 11/2009 | Tseng et al. |
| 2009/0298577 | A1 | 12/2009 | Gagner et al. |
| 2009/0302535 | A1 | 12/2009 | Ho et al. |
| 2009/0302537 | A1 | 12/2009 | Ho et al. |
| 2009/0312093 | A1 | 12/2009 | Walker et al. |
| 2009/0314188 | A1 | 12/2009 | Toyama et al. |
| 2010/0013152 | A1 | 1/2010 | Grauzer |
| 2010/0038849 | A1 | 2/2010 | Scheper et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0244382 | A1 | 9/2010 | Snow |
| 2010/0252992 | A1 | 10/2010 | Sines |
| 2010/0255899 | A1 | 10/2010 | Paulsen |
| 2010/0276880 | A1 | 11/2010 | Grauzer et al. |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer |
| 2011/0006480 | A1 | 1/2011 | Grauzer |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta |
| 2011/0078096 | A1 | 3/2011 | Bounds |
| 2011/0079959 | A1 | 4/2011 | Hartley |
| 2011/0105208 | A1 | 5/2011 | Bickley |
| 2011/0109042 | A1 | 5/2011 | Rynda |
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230148 | A1 | 9/2011 | Demuynck et al. |
| 2011/0230268 | A1 | 9/2011 | Williams |
| 2011/0269529 | A1 | 11/2011 | Baerlocher |

(56) References Cited

U.S. PATENT DOCUMENTS

| | | | |
|---|---|---|---|
| 2011/0272881 | A1 | 11/2011 | Sines |
| 2011/0285081 | A1 | 11/2011 | Stasson |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1 | 4/2012 | Blaha et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer |
| 2012/0181747 | A1 | 7/2012 | Grauzer et al. |
| 2012/0187625 | A1 | 7/2012 | Downs, III et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0023318 | A1 | 1/2013 | Abrahamson |
| 2013/0085638 | A1 | 4/2013 | Weinmann et al. |
| 2013/0099448 | A1 | 4/2013 | Scheper et al. |
| 2013/0109455 | A1 | 5/2013 | Grauzer et al. |
| 2013/0132306 | A1 | 5/2013 | Kami et al. |
| 2013/0147116 | A1 | 6/2013 | Stasson |
| 2013/0161905 | A1 | 6/2013 | Grauzer et al. |
| 2013/0228972 | A1 | 9/2013 | Grauzer et al. |
| 2013/0241147 | A1 | 9/2013 | McGrath |
| 2013/0300059 | A1 | 11/2013 | Sampson et al. |
| 2013/0337922 | A1 | 12/2013 | Kuhn |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2015/0021242 | A1 | 1/2015 | Johnson |
| 2015/0069699 | A1 | 3/2015 | Blazevic |
| 2015/0196834 | A1 | 7/2015 | Snow |
| 2015/0238848 | A1 | 8/2015 | Kuhn et al. |
| 2015/0251079 | A1 | 9/2015 | Wright |
| 2017/0157499 | A1 | 6/2017 | Krenn et al. |
| 2018/0043241 | A1* | 2/2018 | Blaha ..... A63F 1/12 |
| 2018/0200610 | A1 | 7/2018 | Riordan et al. |

FOREIGN PATENT DOCUMENTS

| | | | |
|---|---|---|---|
| AU | 697805 | B2 | 10/1998 |
| AU | 757636 | B2 | 2/2003 |
| CA | 2266555 | A1 | 9/1996 |
| CA | 2284017 | A1 | 9/1998 |
| CA | 2612138 | A1 | 12/2006 |
| CN | 2051521 | U | 1/1990 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CZ | 24952 | U1 | 2/2013 |
| DE | 0291230 | C | 4/1916 |
| DE | 2816377 | A1 | 10/1979 |
| DE | 3807127 | A1 | 9/1989 |
| DE | 2757341 | A1 | 9/1998 |
| EP | 0777514 | B1 | 2/2000 |
| EP | 1502631 | A1 | 2/2005 |
| EP | 1713026 | A1 | 10/2006 |
| EP | 1194888 | A1 | 8/2009 |
| EP | 2228106 | A1 | 9/2010 |
| EP | 1575261 | B1 | 8/2012 |
| FR | 2375918 | A1 | 7/1978 |
| GB | 289552 | A | 4/1928 |
| GB | 337147 | A | 9/1929 |
| GB | 414014 | A | 7/1934 |
| GB | 672616 | A | 5/1952 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003-154320 | A | 5/2003 |
| JP | 2003250950 | A | 9/2003 |
| JP | 2005198668 | A | 7/2005 |
| JP | 2006-092140 | A | 4/2006 |
| JP | 2008246061 | A | 10/2008 |
| JP | 4586474 | B2 | 11/2010 |
| TW | M335308 | U | 7/2008 |
| TW | M357307 | U | 5/2009 |
| TW | M359356 | U | 6/2009 |
| TW | I345476 | B | 7/2011 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |
| WO | 9952610 | A1 | 10/1999 |
| WO | 9952611 | A1 | 10/1999 |
| WO | 200051076 | A1 | 8/2000 |
| WO | 156670 | A1 | 8/2001 |
| WO | 178854 | A3 | 10/2001 |
| WO | 205914 | A1 | 1/2002 |
| WO | 3026763 | A1 | 4/2003 |
| WO | 2004067889 | A1 | 12/2004 |
| WO | 2004112923 | A1 | 12/2004 |
| WO | 2006031472 | A2 | 3/2006 |
| WO | 2006039308 | A2 | 4/2006 |
| WO | 3004116 | A1 | 11/2007 |
| WO | 2008005286 | A2 | 1/2008 |
| WO | 2008006023 | A2 | 1/2008 |
| WO | 2008091809 | A2 | 7/2008 |
| WO | 2009067758 | A1 | 6/2009 |
| WO | 2009137541 | A2 | 11/2009 |
| WO | 2010052573 | A2 | 5/2010 |
| WO | 2010055328 | A2 | 5/2010 |
| WO | 2010117446 | A2 | 10/2010 |
| WO | 2012/053074 | A1 | 4/2012 |
| WO | 2013019677 | A2 | 2/2013 |
| WO | 2016058085 | A9 | 4/2016 |

OTHER PUBLICATIONS

"ACE, Single Deck Shuffler," Shuffle Master, Inc., (2005), 2 pages.

Advansys, "Player Tracking" http://advansys.si/products/tablescanner/player-tracking/[Sep. 23, 2016 1:41:34 PM], 4 pages.

Australian Examination Report for Australian Application No. 2016204157, dated Jul. 22, 2017, 4 pages.

Australian Examination Report for Australian Application No. 2016204158, dated Jul. 22, 2017, 5 pages.

(56) References Cited

OTHER PUBLICATIONS

Australian Examination Report for Australian Application No. 2008202752, dated Sep. 25, 2009, 2 pages.
Australian Examination Report for Australian Application No. 2010202856, dated Aug. 11, 2011, 2 pages.
Australian Provisional Patent Application for Australian Patent Application No. PM7441, filed Aug. 15, 1994, Applicants: Rodney G. Johnson et al., Title: Card Handling Apparatus, 13 pages.
"Automatic casino card shuffle," Alibaba.com, (last visited Jul. 22, 2014), 2 pages.
Bally Systems Catalogue, Ballytech.com/systems, 2012, 13 pages.
Canadian Office Action for CA 2,580,309 dated Mar. 20, 2012 (6 pages).
Canadian Office Action for App No. 2813348, dated Aug. 15, 2017, 4 pages.
Canadian Office Action for Canadian Application No. 2,461,726, dated Jul. 19, 2010, 3 pages.
Canadian Office Action for Canadian Application No. 2,461,726, dated Dec. 11, 2013, 3 pages.
CasinoTrac TableTrac Services. Product Information Datasheet [online]. CasinoTrac, 2015. Retrieved on Oct. 12, 2016 from the Internet: <URL: http://www.tabletrac.com/?pageid=15#prettyPhoto> (3 pages).
Christos Stergiou and Dimitrios Siganos, "Neural Networks," http://www.doc.ic.ac.ukt/~nd/surprise_96/journal/vol4/cs11/report.html (13 pages), Dec. 15, 2011.
Complaint filed in the matter of *SHFL entertainment, In.* v. *DigiDeal Corporation*, U.S. District Court, District of Nevada, Civil Action No. CV 2:12-cv-01782-GMC-VCF, Oct. 10, 2012, 62 pages.
CONNECT2TABLE Administrator Manual, Jan. 7, 2013 (82 pages).
CONNECT2TABLE Quick Installation Guide, Feb. 20, 2013 (36 pages).
CONNECT2TABLE Connect2Table System Summary, generated Oct. 21, 2016 (2 pages).
CONNECT2TABLE User Manual, Feb. 7, 2013 (35 pages).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, part 3 of 23 (Binder 2, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in case of *Shuffle Master, Inc.* v. *Card Aurstia, et al.*, Case No. CV-N-0508-HDM-(VPC) consolidated with Case No. CV-N-02-0244-ERC-(RAM)), May 6, 2003, scan of color pages, for clarity, Part 19 of 23 (color copies from Binder 3).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Austria, et al.*, Case No. Cv-N-0508-HDM-(VPC) (Consolidated with Case No. CV-N-02-0244-ERC-(RAM)), May 6, 2003, Part 6 of 23 (Binder 3, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 20 of 23 (color copies from Binder 4).
Documents submitted in the case of *Shuffle Master, Inc.* v. *Card Austria, et al.*, Case No. Cv-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 21 of 23 (color copies from Binder 6).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-05-0244-ERC-(RAM)), May 6, 2003, Part 9 of 23 (Binder 5 having no contents; Binder 6, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 22 of 23 (color copies from Binder 8, part 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in the case of *Shuffle Master, Inc.* v. *Card Austria, et al.*, Case No. Cv-N-0508-HDM-(VPC) (Consolidated with Case No. CV-N-02-0244-ERC-(RAM)), May 6, 2003, Part 16 of 23 (Binder 8, 4 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
DVD labeled Exhibit 1. This is a DVD taken by Shuffle Master personnel of the live operation of a CARD One2Si| Shuffler (Oct. 7, 2003). DVD sent to Examiner by US Postal Service with this PTO/SB/08 form.
DVD labeled Morrill Decl. Ex. A is (see Binder 4-1, p. 149/206, Morrill Decl., para. 2.): A video (16 minutes) that the attorney for CARD, Robert Morrill, made to describe the Roblejo prototype card shuffler. DVD sent to Examiner by US Postal Service with this PTO/SB/08 form.
DVD labeled Solberg Decl.Ex.C, which is not a video at all, is (see Binder 4-1, p. 34/206, Solberg Decl., para.8): Computer source code for operating a computer-controlled card shuffler (an early Roblejo

(56) References Cited

OTHER PUBLICATIONS prototype card shuffler) and descriptive comments of how the code works. DVD sent to Examiner by US Postal Service with this PTO/SB/08 form.
DVD labeled Luciano Decl. Ex. K is (see Binder 2-1, p. 215/237, Luciano Decl., para.14): A video demonstration (11minutes) of a Luciano Packaging prototype shuffler. DVD sent to Examiner by US Postal Service with this PTO/SB/08 form.
European Search Report for European Application No. 17163607.9 dated Sep. 15, 2017, 6 pages.
"Error Back propagation," http://willamette.edu~gorr/classes/cs449/backprop.html (4 pages), Nov. 13, 2008.
Canadian Office Action for Canadian Application No. 2813348, dated Jul. 3, 2018, 4 pages.
Weisenfeld, Bernie; Inventor betting on shuffler; Courier-Post; Sep. 11, 1990; 1 page.
Solberg, Halyard; Deposition; *Shuffle Tech International* v. *Scientific Games Corp., et al*. 1:15-cv-3702 (N.D. III.); Oct. 18, 2016; pp. 187, 224-246, 326-330, 338-339, 396; Baytowne Reporting; Panama City, FL.
Prototype Glossary and Timelines; *Shuffle Tech International* v. *Scientific Games Corp., et al*. 1:15-cv-3702 (N.D. III.); undated; pp. 1-4.
Olsen, Eddie; Automatic Shuffler 'ready' for Atlantic City experiment; Blackjack Confidential; Jul./Aug. 1989; pp. 6-7.
Gros, Roger; New Card Management System to Be Tested At Bally's Park Place; Casino Journal; Apr. 1989; 5 pages.
Gola, Steve; Deposition; *Shuffle Tech International* v. *Scientific Games Corp., et al*. 1:15-cv-3702 (N.D. III.); Oct. 13, 2016; pp. 1, 9-21, 30-69, 150-167, 186-188, 228-231, 290-315, 411; Henderson Legal Services, Inc.; Washington, DC.
*Shuffle Tech International LLC et al*. vs. *Scientific Games Corporation et al.*, Order Denying Motion for Summary Judgement: Memorandum Opinion and Order, in the U.S. District Court, for The Northern District of Illinois Eastern Division, No. 15 C 3702, Sep. 1, 2017, 35 pages.
"TableScanner (TM) from Advansys", Casino Inside Magazine, No. 30, pp. 34-36 (Dec. 2012) (4 pages).
TableScanner "Accounting & Cage". Product Information Datasheets [online]. Advansys, 2013. Retrieved on Oct. 11, 2016 from the Internet: <URL: http://advansys.si/products/tablescanner/accounting-cage/> (4 pages).
TableScanner "Casino Management System". Product Information Datasheets [online]. Advansys, 2013. Retrieved on Oct. 11, 2016 from the Internet: <URL: http://advansys.si/> (6 pages).
TableScanner "Multisite". Product Information Datasheets [online]. Advansys, 2013. Retrieved on Oct. 11, 2016 from the Internet: <URL: http://advansys.si/products/tablescanner/multisite/> (3 pages).
TableScanner "Player Tracking". Product Information Datasheets [online]. Advansys, 2013. Retrieved on Sep. 23, 2016 rom the Internet: <URL: http://advansys.si/products/tablescanner/player-tracking/> (4 pages).
TableScanner "Table Management system". Product Information Datasheets [online]. Advansys, 2013. Retrieved on Oct. 11, 2016 from the Internet: <URL: http://advansys.si/products/tablescanner/> (4 pages).
"Tag Archives: Shuffle Machine," Gee Wiz Online, (Mar. 25, 2013), 4 pages.
Tbm=pts&hl=en Google Search for card handling device with storage area, card removing system pivoting arm and processor; http://www.google.com/?tbrn=pts&hl=en; Jul. 28, 2012, 2 pages.
Tracking the Tables, by Jack Bularsky, Casino Journal, May 2004, vol. 17, No. 5, pp. 44-47.
"TYM @ a Glance—Table Games Yield Management", TYM Live Product Information Datasheets [online]. Tangam Systems, 2016. Retrieved on Oct. 3, 2016 from the Internet: <URL: http://tangamgaming.com/wp-content/uploads/2016/12/TG_TYMGlance_2016-V4-1.pdf> (2 pages).
United States Court of Appeals for the Federal Circuit Decision Decided Dec. 27, 2005 for Preliminary Injuction for *Shuffle Master, Inc*. vs. *VendingData Corporation*, in the U.S. District Court, District of Nevada, No. CV-S-04-1373-JCM-LRL.
VendingData Corporation's Answer and Counterclaim Jury Trial Demanded for *Shuffle Master, Inc*. vs. *VendingData Corporation*, in the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc*. vs. *VendingData Corporation*, in the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc*. vs. *VendingData Corporation*, in the U.S. District Court, District of Nevada, No. CV-S-04-1373-JCM-LRL, Mar. 14, 2005.
Canadian Office Action from Canadian Application No. 2995664, dated Jun. 4, 2019, 5 pages.
European Search Report for European Application No. 12 152 303, dated Apr. 16, 2012, 3 pages.
European Patent Application Search Report—European Patent Application No. 06772987.1, dated Dec. 10, 2009, 5 pages.
European Examination Report for European Application No. 02 780 410, dated Jan. 25, 2010, 5 pages.
European Examination Report for European Application No. 02 780 410, dated Aug. 9, 2011, 4 pages.
Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol-11-no-5-may-2012/article/talking-tables> (4 pages).
Genevieve Orr, CS-449: Neural Networks Willamette University, http://www.willamette.edu/~gorr/classes/cs449/intro.html (4 pages), Fall 1999.
http://www.google.com/search?tbm=pts&q=Card+handling+devicve+with+input+and+outpu . . . Jun. 8, 2012.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
http://www.google.com/search?tbm=pts&q=shuffling+zone+onOopposite+site+of+input+ . . . Jul. 18, 2012.
"i-Deal," Bally Technologies, Inc., (2014), 2 pages.
Shuffle Master, Inc. (1996). Let It Ride, The Tournament, User Guide, 72 pages.
Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, dated May 9, 2009, 4 pages.
Neon Product Information Datasheets [online]. "Enterprise Casino Management, Table Management System, Mobile, Gaming". Intelligent Gaming, 2014. Retrieved on Oct. 12, 2016 from the Internet: <URL: http://www.intelligentgaming.co.uk/products/neon-enterprise/> (4 pages).
PCT International Preliminary Examination Report for International Patent Application No. PCT/US02/31105 dated Jul. 28, 2004, 9 pages.
PCT International Search Report for International Application No. PCT/US2003/015393, dated Oct. 6, 2003, 2 pages.
PCT International Search Report and Written Opinion, PCT/US2012/48706, dated Oct. 16, 2012, 12 pages.
PCT International Search Report for PCT/US2005/034737 dated Apr. 7, 2006, 1 page (WO06/039308).
PCT International Search Report for PCT/US2007/022894, dated Jun. 11, 2008, 3 pages.
PCT International Search Report and Written Opinion of the International Searching Authority for PCT/US2010/001032, dated Jun. 16, 2010, 11 pages.
PCT International Search Report and Written Opinion for PCT/US07/15035, dated Sep. 29, 2008, 6 pages.
PCT International Search Report and Written Opinion for PCT/US07/15036, dated Sep. 23, 2008, 6 pages.
PCT International Search Report and Written Opinion, PCT Application No. PCT/US2015/051038, dated Jan. 22, 2016, 11 pages.

(56) References Cited

OTHER PUBLICATIONS

PCT International Search Report and Written Opinion of the International Searching Authority for PCT/US2008/007069, dated Sep. 8, 2008, 10 pages.
PCT International Search Report and Written Opinion, PCT Application No. PCT/US2015/022158, dated Jun. 17, 2015, 13 pages.
PCT International Search Report and Written Opinion for International Application No. PCT/US2007/023168, dated Sep. 12, 2008, 8 pages.
PCT International Search Report and Written Opinion, PCT Application No. PCT/US2015/040196, dated Jan. 15, 2016, 20 pages.
PCT International Search Report and Written Opinion, PCT Application No. PCT/US2013/062391, dated Dec. 17, 2013, 13 pages.
PCT International Search Report and Written Opinion of the International Searching Authority for PCT/US05/31400, dated Sep. 25, 2007, 12 pages.
PCT International Search Report and Written Opinion, PCT Application No. PCT/US2015/025420, dated Oct. 2, 2015, 15 pages.
PCT International Search Report and Written Opinion of the International Searching Authority for PCT/US13/59665, dated Apr. 25, 2014, 21 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion for International Application No. PCT/US2007/022858, dated Mar. 7, 2008, 7 pages.
PCT International Search Report and Written Opinion for International Patent Application No. PCT/US2006/22911, dated Jun. 1, 2007, 6 pages.
PCT International Search Report and Written Opinion of the International Searching Authority for PCT/GB2011/051978, dated Jan. 17, 2012, 11 pages.
Philippines Patent Application Formality Examination Report—Philippines Patent Application No. 1-2006-000302, dated Jun. 13, 2006.
"Playtech Retail begins roll out of Neon across Grosvenos 55 UK Casinos". Playtech, Apr. 21, 2016. Retrieved on Oct. 11, 2016 from the Internet: <URL: https://www.playtech.com/news/latest_news_and_prs/playtech_retail_begins_roll_out_of_neon_across_grosvenor_s_55_uk_casinos> (1 page).
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Scarne's Encyclopedia of Games by John Scarne, 1973, "Super Contract Bridge", p. 153.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Master, Inc.
Service Manual/User Manual for Single Deck Shufflers: BG1, BG2 and BG3 by Shuffle Master ©1997, 151 page.
Singapore Patent Application Examination Report—Singapore Patent Application No. SE 2008 01914 A, dated Jun. 18, 2008, 9 pages.
SHFL Entertainment, Inc., Opening Claim Construction Brief, filed in Nevada District Court Case No. 2:12-cv-01782 with exhibits, Aug. 8, 2013, p. 1-125.
Shuffle Master's Reply Memorandum in Support of Shuffle Master's Motion for Preliminary Injunction for *Shuffle Master, Inc.* vs. *VendingData Corporation*, in the U.S. District Court, District of Nevada, No. CV-S-04-1373-JCM-LRL, Nov. 29, 2004.
"shufflers—SHFL entertainment," Gaming Concepts Group, (2012), 6 pages.
Statement of Relevance of Cited References, Submitted as Part of a Third-Party Submission Under 37 CFR 1.290 on Dec. 7, 2012 (12 pages).
European Examination Report from European Application No. 17163607.9, dated Oct. 4, 2018, 3 pages.
Notice of Reasons for Rejection from Korean Application No. 10-2013-7012301, dated Jan. 2, 2018, 6 pages including English translation.
U.S. Appl. No. 15/276,476, filed Sep. 26, 2016, titled "Devices, Systems, and Related Methods for Real-Time Monitoring and Display of Related Data for Casino Gaming Devices", to Nagaragatta et al., 36 pages.
U.S. Appl. No. 15/365,610, filed Nov. 30, 2016, titled "Card Handling Devices and Related Assemblies and Components", to Helsen et al., 62 pages.
Macau Office Action and Search Report from Macau Application No. I/1123, dated Feb. 14, 2019, 14 pages.
Taiwanese Office Action and Search Report from Taiwanese Application No. 106133407, dated Sep. 4, 2018, 9 pages.

* cited by examiner

METHODS OF OPERATING CARD HANDLING DEVICES OF CARD HANDLING SYSTEMS

CROSS-REFERENCE TO RELATED APPLICATIONS

This application is a divisional of U.S. patent application Ser. No. 14/456,733, filed Aug. 11, 2014, now U.S. Pat. No. 9,802,114, issued Oct. 31, 2017, which is a divisional of U.S. patent application Ser. No. 13/270,109, filed Oct. 10, 2011, now U.S. Pat. No. 8,800,993, issued Aug. 12, 2014, which claims the benefit of U.S. Provisional Patent Application Ser. No. 61/393,299, filed Oct. 14, 2010, the disclosure of each of which is hereby incorporated herein in its entirety by this reference.

TECHNICAL FIELD

Embodiments of the present disclosure relate generally to the field of gaming and the field of casino table card gaming. More particularly, embodiments of the disclosure relate to systems and devices for the handling of playing cards and related methods.

BACKGROUND

Wagering games based on the outcome of randomly generated arrangements of cards are well known. Such games are widely played in gaming establishments and, often, a single deck or multiple decks of fifty-two (52) playing cards may be used to play the game. Gaming using multiple decks of playing cards may include, for example, six or eight decks used in games such as blackjack and baccarat and two decks of playing cards used in games such as double deck blackjack. Many other specialty games may use single or multiple decks of cards, with or without jokers and with or without selected cards removed.

From the perspective of players, the time the dealer must spend in shuffling diminishes the excitement of the game. From the perspective of casinos, shuffling time reduces the number of hands played and specifically reduces the number of wagers placed and resolved in a given amount of time, consequently reducing casino revenue. Casinos would like to increase the amount of revenue generated by a game without changing the game or adding more tables. One approach is to simply speed up play. One option to increase the speed of play is to decrease the time the dealer spends shuffling.

The desire to decrease shuffling time has led to the development of mechanical and electromechanical card shuffling devices. Such devices increase the speed of shuffling and dealing, thereby increasing actual playing time. Such devices also add to the excitement of a game by reducing the amount of time the dealer or house has to spend in preparing to play the game.

Dealers appreciate using card shufflers that place minimum strain on the dealer's hands, back, and arms. Some existing shuffler designs put unnecessary strain on the muscles of the users. Dealers prefer shufflers that exhibit a low profile with respect to the surface of the gaming table, especially when the shuffler dispenses cards into a game rather than shufflers that shuffle batches of cards for shoe games.

Numerous approaches have been taken to the design of card shufflers. These approaches include random ejection designs (e.g., U.S. Pat. Nos. 6,959,925; 6,698,756; 6,299, 167; 6,019,368; 5,676,372; and 5,584,483), stack separation and insertion (e.g., U.S. Pat. Nos. 5,683,085 and 5,944,310), interleaving designs (e.g., U.S. Pat. Nos. 5,275,411 and 5,695,189), for example, random insertion using a blade (U.S. Pat. No. 5,382,024), and designs that utilize multiple shuffling compartments.

One such example of a compartment shuffler is disclosed in U.S. Pat. No. 4,586,712 to Lorber et al. The automatic shuffling apparatus disclosed is designed to intermix multiple decks of cards under the programmed control of a computer. The apparatus is a carousel-type shuffler having a container, a storage device for storing shuffled playing cards, a removing device and an inserting device for intermixing the playing cards in the container, a dealing shoe, and supplying means for supplying the shuffled playing cards from the storage device to the dealing shoe. The container includes multiple card-receiving compartments, each one capable of receiving a single card.

Another shuffler having mixing compartments arranged in a carousel is disclosed in U.S. Pat. No. 6,267,248 to Johnson et al. Cards are loaded into an infeed tray, fed sequentially past a card reading sensor, and are inserted into compartments within a carousel to either randomize or sort cards into a preselected order. The carousel moves in two directions during shuffling. U.S. Pat. No. 6,676,127 to Johnson et al. describes another variation of the shuffler, in which cards are inserted into and removed from a same side of the carousel, with the card infeed tray being located above the discard tray (see FIG. 3).

U.S. Pat. No. 3,897,954 to Erickson et al. discloses a device for delivering cards, one at a time, into one of a number of vertically stacked card-shuffling compartments. A logic circuit is used to determine the sequence for determining the delivery location of a card. The card shuffler can be used to deal stacks of shuffled cards to a player.

U.S. Pat. No. 4,770,421 to Hoffman discloses a card-shuffling device including a card loading station with a conveyor belt. The belt moves the lowermost card in a stack onto a distribution elevator whereby a stack of cards is accumulated on the distribution elevator. Adjacent to the elevator is a vertical stack of mixing pockets. A microprocessor preprogrammed with a finite number of distribution schedules sends a sequence of signals to the elevator corresponding to heights called out in the schedule. Each distribution schedule comprises a preselected distribution sequence that is fixed, as opposed to random. Single cards are moved into the respective pocket at that height. The distribution schedule is either randomly selected or schedules are executed in sequence. When the microprocessor completes the execution of a single distribution cycle, the cards are removed a stack at a time and loaded into a second elevator. The second elevator delivers cards to an output reservoir.

U.S. Pat. No. 5,275,411 to Breeding discloses a machine for automatically shuffling and dealing hands of cards. Although this device does not shuffle cards by distributing cards to multiple compartments, the machine is believed to be the first of its kind to deliver randomly arranged hands of cards to a casino card game. A single deck of cards is shuffled and then cards are automatically dispensed into a hand-forming tray. The shuffler includes a deck-receiving zone, a carriage section for separating a deck into two deck portions, a sloped mechanism positioned between adjacent corners of the deck portions, and an apparatus for snapping the cards over the sloped mechanism to interleave the cards. The Breeding shuffler was originally designed to be used in connection with single deck poker style games such as LET IT RIDE® Stud Poker and a variant of Pai Gow Poker marketed as WHO'S FIRST™ Pai Gow Poker.

In an attempt to speed the rate of play of specialty table games equipped with a shuffler, the ACE® card shuffler, as disclosed in U.S. Pat. Nos. 6,149,154, 6,588,750, 6,655,684, and 7,059,602, was developed. This shuffler operates at faster speeds than previously known shuffler devices described above, has fewer moving parts, and requires much shorter setup time than the prior designs. The shuffler includes a card infeed tray, a vertical stack of shuffling compartments and a card output tray. A first card moving mechanism (card mover) advances cards individually from the infeed tray into a compartment. A processor randomly directs the placement of fed cards into the compartments, and an alignment of each compartment with the first card mover, forming random groups of cards within each compartment. Groups of cards are unloaded by a second card moving mechanism into the output tray.

Another compartment shuffler capable of delivering randomly arranged hands of cards for use in casino card games is the ONE2SIX® shuffler (developed by Shuffle Master GMBH & Co KG, formerly known as Casino Austria Research & Development (CARD)). This shuffler is disclosed in U.S. Pat. Nos. 6,659,460 and 6,889,979. This shuffler is capable of delivering randomly arranged hands of cards when a first removable delivery end is attached, and is capable of delivering a continuous supply of cards from a shoe-type structure when a second removable delivery end is attached. Cards are fed from a feeder individually into compartments within a carousel to accomplish random ordering of cards. Shuffling is also accomplished by random unloading of groups of cards.

Most of the known shuffler designs, in particular multi-deck shufflers, require some sort of interaction (e.g., by a dealer) in the shuffling process such as removing the shuffled playing cards from the shuffler and placing the cards in a shoe for use by a dealer. Such interaction and transfer of the cards to a different device may compromise the security of the cards during the shuffling process and create opportunities for tampering with the cards. Furthermore, in most of the known shuffler designs, shuffling of the playing card may be limited by the particular mechanism used in the shuffler for loading additional cards in the shuffler.

BRIEF SUMMARY

In some embodiments, the present disclosure includes a card handling system including a shuffling device comprising a first card sensing device, a shoe device comprising a second card sensing device, a card transfer system for transferring cards from the shuffling device into the shoe device, and a processor for controlling operation of the system.

In additional embodiments, the present disclosure includes a shuffling device including a card infeed area, a first card feed mechanism for transporting cards from the card infeed area to a carousel comprising a plurality of compartments, and a divider positioned proximate to the carousel and operable to contact at least one card positioned within at least one compartment of the plurality of compartments of the carousel.

In yet additional embodiments, the present disclosure includes a shoe device including a card storage area and a card loading system for loading cards into the card storage area through an opening in a base of the shoe device.

In further embodiments, the present disclosure includes a method of providing cards during casino table game play. The method includes receiving cards into a shuffling device positioned at least partially below a playing surface of a gaming table, obtaining card information including a rank and a suit of each card as the card moves through the shuffling device, transporting the card from the shuffling device to a shoe device positioned over a playing surface of a gaming table, obtaining card information including a rank and a suit of each card as the card moves through the shoe device, and supplying the card through a card output area of the shoe device.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure provided with reference to the accompanying drawings, in which:

DETAILED DESCRIPTION

The illustrations presented herein are not actual views of any particular device, system, or components thereof, but are merely idealized representations that are employed to describe embodiments of the present disclosure. Additionally, elements common between figures may retain the same numerical designation for convenience and clarity.

Figure 1:
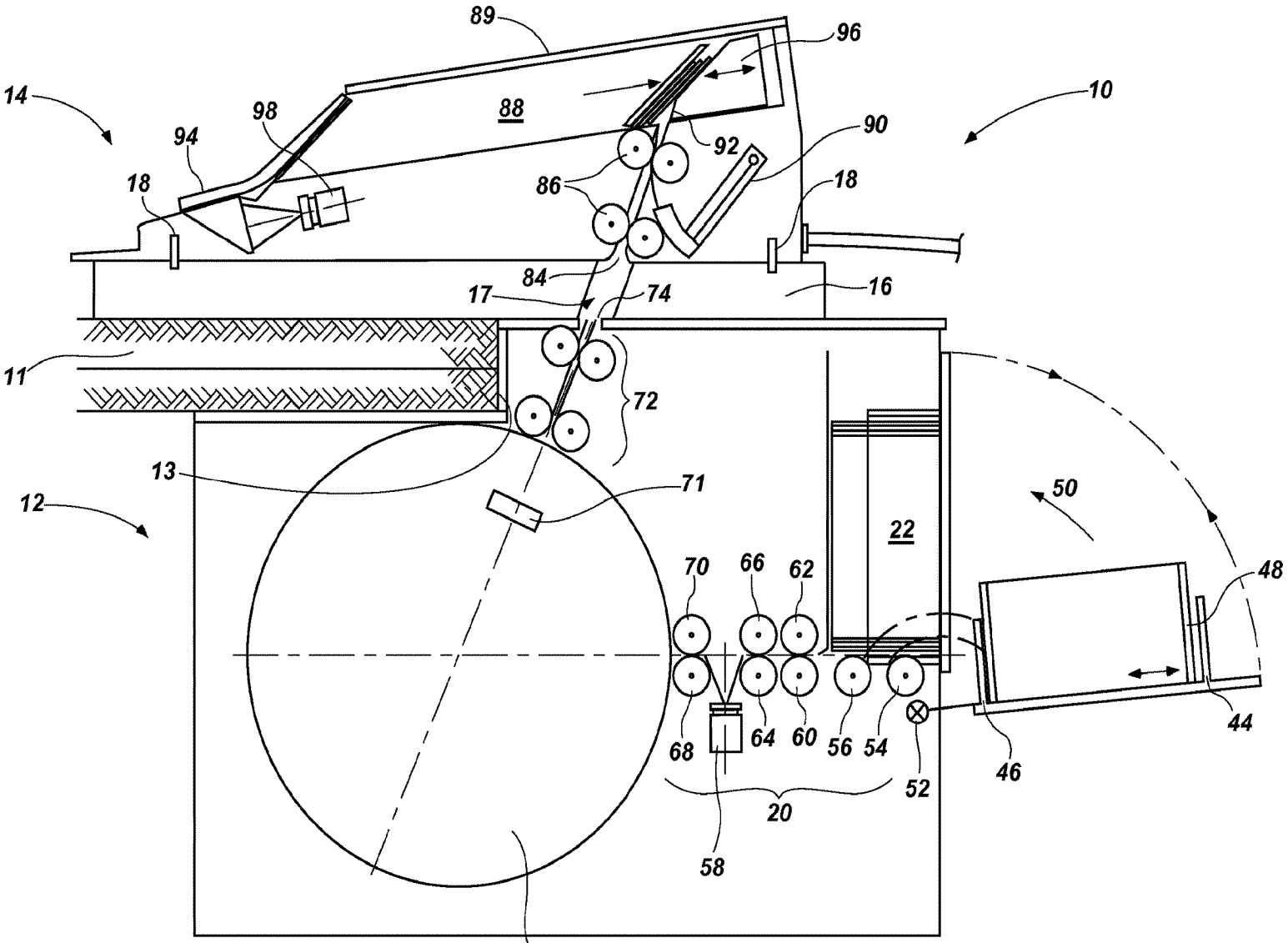
FIG. 1 is a partial cross-sectional side view of a card handling system including a shuffling device and a shoe device in accordance with an embodiment of the present disclosure.

FIG. 1 is a partial cross-sectional side view of an embodiment of a card handling system 10 including card handling devices such as, for example, a shuffling device 12 and a shoe device 14. The card handling system 10 may be implemented to provide shuffled (e.g., randomized, sorted, etc.) cards for use in, for example, a casino table game (e.g., baccarat, blackjack, CASINO WAR®, or other single- and multi-deck games). The card handling system 10 may include a playing card infeed area (e.g., a card input area 22 in the shuffling device 12) for supplying playing cards to the card handling system 10 and card output area (e.g., a discharge end 94 of the shoe device 14) for supplying playing cards for use in a game (e.g., for use by a dealer).

As shown in FIG. 1, the card handling system 10 may be positioned such that the shuffling device 12 and the shoe device 14 are mounted to a gaming table 11 in an orientation to supply playing cards from the shuffling device 12 to the shoe device 14. For example, the shoe device 14 may be mounted (e.g., removably mounted) over the gaming table 11 (e.g., over or on a playing surface of the gaming table 11) while the shuffling device 12 is mounted below (e.g., at least partially underneath, external to a playing surface, etc.) the gaming table 11 proximate to the shoe device 14. In other words, the shoe device 14 is positioned relatively more proximate to a playing surface of the gaming table 11 while the shuffling device 12 relatively more distant from (i.e., distal or external to) the playing surface of the gaming table 11 as compared to the shoe device 14. In some embodiments, the card handling system 10 may be at least partially mounted proximate a side portion 13 of the gaming table 11. For example, a portion of the card handling system 10 (e.g., the shuffling device 12) may be partially mounted below the gaming table 11 and may extend from the side portion 13 of the gaming table 11. The portion of the card handling system 10 extending from the side portion 13 of the gaming table 11 may enable the shoe device 12 to be positioned directly on a portion of the card handling system 10. A portion of a card transfer system (i.e., a card path) between the shuffling device 12 and the shoe device 14 (e.g., card output 74, card path 17, discussed below) may be positioned adjacent to (e.g., external to) the gaming table 11 and may not extend through the gaming table 11. As shown in FIG. 1, such an embodiment may eliminate the need to cut holes for a card path between the shuffling device 12 and the shoe device 14 in the gaming table 11.

In some embodiments, a docking station 16 may be mounted on the gaming table 11 between the shuffling device 12 and the shoe device 14. The docking station 16 may include a mounting device (e.g., one or more alignment pins 18) protruding therefrom to receive the shoe device 14. The alignment pins 18 may align the shoe device 14 with the docking station 16 and with the shuffling device 12 in order to align a card transfer system between the shuffling device 12 and the shoe device 12. For example, the alignment pins 18 may align a card path 17 extending through the docking station 16 with an opening (e.g., card output 74) in the shuffling device 12 and an opening (e.g., card input 84) of the shoe device 14. In other embodiments, a docking station may comprise alignment pins 18 that are mounted directly into a gaming table 11 and the shoe device 14 may be disposed directly on the gaming table 11 and attached to the alignment pins 18, thereby, eliminating the need for the docking station 16 having the card path 17 formed therethrough. The alignment pins 18 may act to align the shuffling device 12, shoe device 14, and docking station 16, if implemented, to assure that playing cards properly load from the shuffling device 12 into the shoe device 14. The alignment pins 18 may enable a plurality of shoe devices 14 to be interchangeably used with the card handling system 10 by enabling each shoe device 14 to be mounted and removed from the card handling system 10 (e.g., from use with the shuffling device 12).

In some embodiments, the card handling system 10 may include a device to indicate whether a shoe device 14 is received on the alignment pins 18 before playing cards are supplied from the shuffling device 12 to the shoe device 14. For example, the card handling system 10 may include one or more sensors 15 (FIG. 5) that send a signal indicating that the shoe device 14 is received on the alignment pins 18. If the sensor 15 does not detect the shoe device 14, the card handling system 10 may prevent playing cards from being supplied from the shuffling device 12 to the shoe device 14. In some embodiments, the card handling system 10 may act to secure the shoe device 14 such that the shoe device 14 may not be removed from the card handling system 10 when playing cards are being supplied from the shuffling device 12 to the shoe device 14. For example, the alignment pins 18 may be received within recesses formed in the shoe device 14 and a portion of one or more alignment pins 18 (e.g., a tab formed thereon) may secure the shoe device 14 to an adjacent structure (e.g., the docking station 16, the gaming table 11) during operation of the card handling system 10.

Referring still to FIG. 1, playing cards may be supplied to the card handling system 10 through a card input area 22 in the shuffling device 12. In some embodiments, the shuffling device 12 may comprise any suitable shuffling device such as, for example, those disclosed in U.S. Pat. No. 5,676,372 to Sines et al. that issued Oct. 14, 1997, U.S. Pat. No. 6,254,096 to Grauzer et al. that issued Jul. 3, 2001, U.S. Pat. No. 6,651,981 to Grauzer et al. that issued Nov. 25, 2003, and U.S. Pat. No. 6,659,460 to Blaha et al. that issued Dec. 9, 2003, the disclosures of each of which are incorporated herein in their entireties by this reference. The shuffling device 12 may have a wheel or carousel design that may be somewhat similar to the card-shuffling device disclosed in the aforementioned and incorporated by reference U.S. Pat. No. 6,659,460. For example, a card feed system 20 delivers cards from a card input area 22 to a multi-compartment carousel 24.

In some embodiments, the card input area 22 of the card handling system 10 may include a translatable magazine 44 (e.g., a rotatable magazine) that may be disposed at least partially within the card input area 22 in a closed position. As shown in FIG. 1, in the open position, the magazine 44 may be positioned to be substantially horizontal (e.g., horizontal with respect to a surface (e.g., floor) on which the card handling system 10 or gaming table 11 is placed). The magazine 44 may have a first fixed side 46 and a movable side 48 that is biased in a direction toward the fixed side to retain playing cards between the sides 46, 48 of the magazine 44. For example, the movable side 48 may be movably coupled to the magazine 44 (e.g., to a track on or in a portion of the magazine 44) and may be biased (e.g., by a spring) in a direction toward the fixed side 46 in order to clamp a horizontal stack of playing cards between the sides 46, 48 (e.g., where a face of each playing card is oriented substantially transverse to a path of the card feed system 20). In some embodiments, a removable cartridge is positioned in the magazine and locks into place in a rotatable support structure. Once the rotatable magazine 44 is loaded with playing cards, the magazine 44 may be rotated into the closed position in direction 50 about axis 52 until the stack of cards is substantially vertical (e.g., where a face of each playing card is oriented substantially parallel to the path of the card feed system 20). The magazine 44 may be locked into a vertical position before the shuffler device 12 is activated. In some embodiments, one or more sensors 47 (FIG. 5) may indicate that the magazine 44 is in a closed position before operation of the card handling system 10 (e.g., the shuffling device 12) is enabled.

In other embodiments, playing cards may be inputted directly into card input area 22 (e.g., a fixed magazine disposed in the card input area 22) or into a removable magazine that is removably coupled to the card handling system 10. For example, the magazine 44 may comprise a removable cartridge (e.g., a frame member) that holds a stack of cards (e.g., six to eight decks of playing cards in a face-to-back orientation). In such an embodiment, the cartridge may be preloaded with one or more decks of playing cards and may be disposed in (e.g., inserted into) the magazine 44. With the cartridge loaded in to the magazine 44, the magazine 44 may be inserted into the card handling system 10.

Figure 1A:
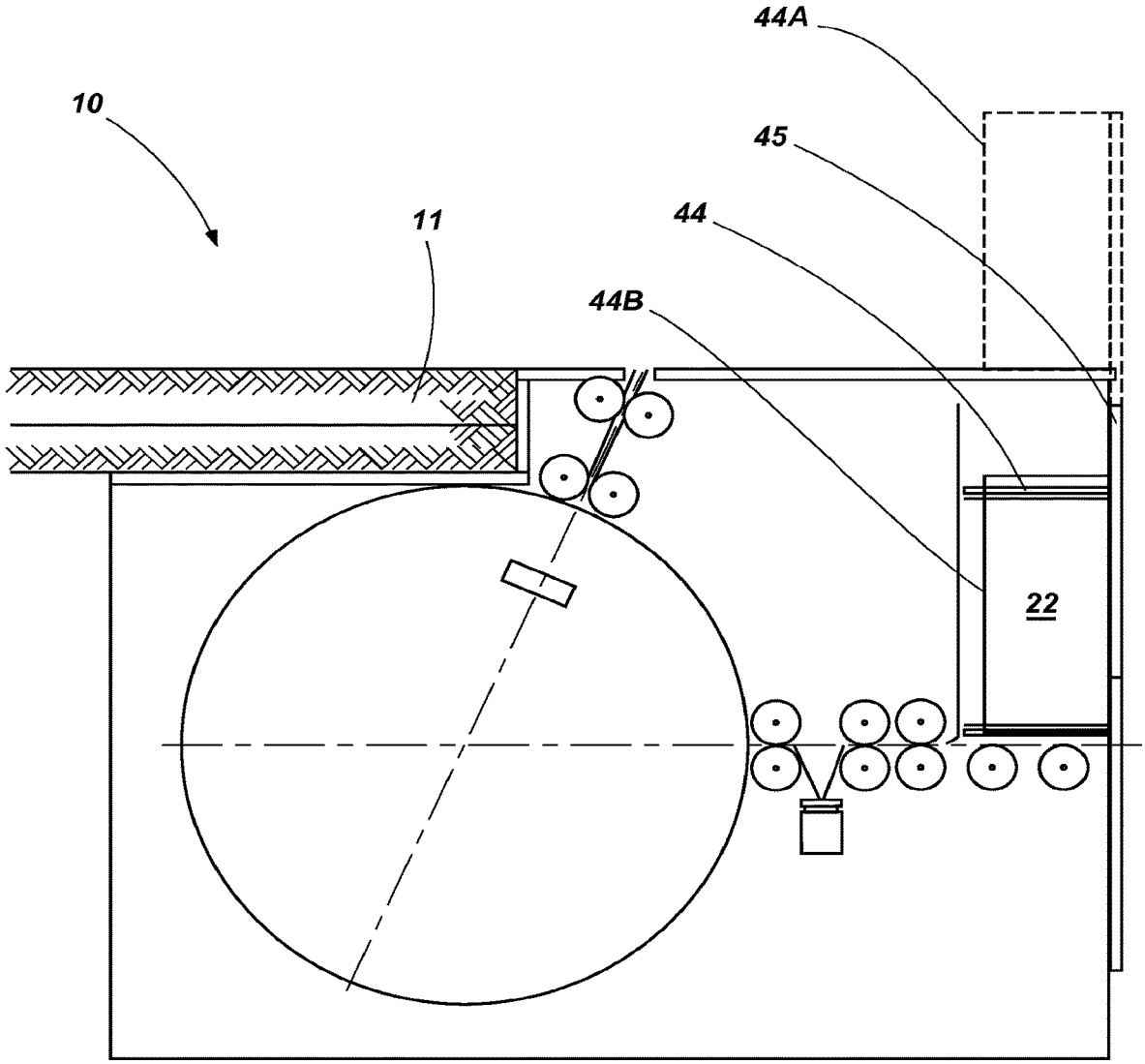
FIG. 1A is a partial cross-sectional side view of a portion of a card handling system in accordance with another embodiment of the present disclosure.

In yet other embodiments and as shown in FIG. 1A, the card input area 22 of the card handling system 10 may include a translatable magazine 44 that is movable between a raised position 44A and a lowered position 44B by an elevator system 45. The translatable magazine 44 may be substantially similar to that described above with reference to FIG. 1. As shown in FIG. 1A, in the raised position, the magazine 44 may be positioned such that at least a portion of the magazine 44 is accessible from the gaming table 11 (e.g., from the playing surface of the gaming table 11). In the raised position, playing cards to be inserted into the card handling system 10 may be loaded into the magazine 44. Once the translatable magazine 44 is loaded with playing cards, the magazine 44 may be displaced into the lowered position (i.e., into the card input area 22) by the elevator system 45 (e.g., an automatic system that is operated by the dealer, the control system 200 (FIG. 5), or combinations thereof).

Referring again to FIG. 1, playing cards inputted into the card input area 22 may be transported from the card input area 22 to the multi-compartment carousel 24 by the card feed system 20. The card feed system 20 may include a set of pick-off rollers 54, 56 that transport cards individually. Additional pairs of rollers 60, 62, 64, 66, 68, 70 may displace playing cards from the card input area 22 to the multi-compartment carousel 24. In some embodiments, one or more components of a card sensing system 58 may be placed proximate to the card input area 22 and card feed system 20 may transport cards past the card sensing system 58. For example, a component or device (e.g., a sensor) of a card sensing system 58 may be disposed along the card feed system 20 to inspect the playing cards before insertion into the multi-compartment carousel 24. The card sensing system 58 may be used to inspect the playing cards and to verify data from inspection of the playing cards against a data set contained in a memory device (e.g., a memory device of the card sensing system 58, of a control system 200 (FIG. 5), etc.) to verify the set of playing cards has not been tampered with (e.g., by verifying that the set of playing card is complete). In some embodiments, the card sensing system 58 may comprise one or more of the components disclosed in U.S. Patent Application Publication No. US 2007/0018389 A1 to Downs that published Jan. 25, 2007, now U.S. Pat. No. 7,933,448, issued Apr. 26, 2011, or in U.S. Pat. No. 7,764,836 to Downs et al., issued Jul. 27, 2010, the disclosure of each of which is incorporated herein in its entirety by this reference.

The shuffling device 12 may include a drive mechanism (e.g., a stepper motor) for rotating the multi-compartment carousel 24 in multiple directions (e.g., clockwise and counterclockwise) and may align a selected compartment 25 (FIG. 2) with the card feed system 20 in order to load one or more playing cards into the selected compartment 25 of the multi-compartment carousel 24. In some embodiments, the drive mechanism may be similar to the drive mechanisms disclosed in the aforementioned and incorporated by reference U.S. Pat. Nos. 6,659,460 and 7,766,332 to Grauzer et al. that issued Aug. 3, 2010, the disclosure of which is incorporated herein in its entirety by this reference.

Figure 2:
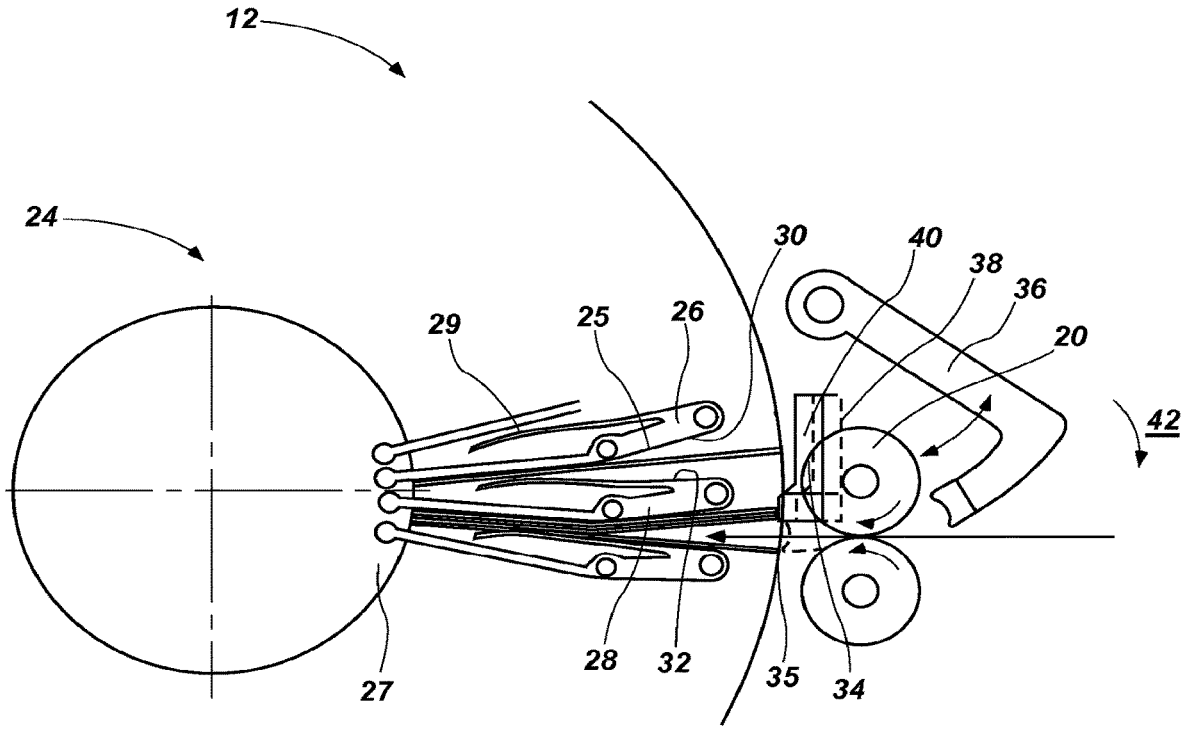
FIG. 2 is a partial cross-sectional view of a portion of a shuffling device that may be used in embodiments of card handling systems of the present disclosure, such as the card handling systems shown in FIGS. 1 and 1A.

FIG. 2 is a partial cross-sectional view of the shuffling device 12. As shown in FIG. 2, the multi-compartment carousel 24 may include a plurality of compartments 25 (e.g., forty-three (43) compartments) formed by fingers 26, 28 extending from a rotatable center member 27. Each compartment 25 may be defined by two adjacent fingers 26, 28 of the multi-compartment carousel 24. In some embodiments, the fingers 26, 28 may include a leaf spring 29 for holding playing cards securely within the compartment 25 after insertion in the multi-compartment carousel 24. It is noted that in other embodiments, the multi-compartment carousel 24 may include fewer than forty-three (43) compartments 25 or more than forty-three (43) compartments 25.

The shuffling device 12 may include a packer arm device 36 for assisting the insertion of playing cards into each compartment 25 of the multi-compartment carousel 24. The packer arm device 36 may be rotatably coupled to a portion of the card handling system 10 and may translate partially along a path of the card feed system 20 to ensure proper loading of playing cards within the multi-compartment carousel 24. In some embodiments, the packer arm device 36 may be similar to the devices disclosed in the aforementioned and incorporated by reference U.S. Pat. Nos. 6,659,460 and 7,766,332.

The shuffling device 12 may include a divider 34 that, in a retracted position 38, may avoid contact with an edge of one or more playing cards (e.g., a stack of playing cards) disposed within the compartment 25 of the multi-compartment carousel 24 that is aligned with feed rollers 20. In an engaged position 40, the divider 34 may contact playing cards and may apply a force thereto. A contact end 35 of the divider 34 may contact an edge of one or more playing cards in a compartment 25 in order to retain the edge of the one or more playing cards proximate to the contact end 35 of the divider 34. For example, the contact end 35 of the divider 34 may contact an edge of one or more playing cards to cause a frictional force therebetween. In some embodiments, the contact end 35 of the divider 34 may contact an edge of one or more playing cards and apply a force thereto in order to at least partially bend a portion of one or more of the playing cards. For example, the divider 34 may cause a slight bend in a stack of playing cards and may cause a separation between the playing cards or between a portion of one or more of the playing cards and a portion of a finger 26, 28 on which the playing cards are disposed. In some embodiments, the contact end 35 of the divider 34 may be smooth, grooved, ribbed, straight, sloped, or covered with high friction material (e.g., rubber or neoprene) in order to retain an edge of one or more of the playing cards.

Figure 3:
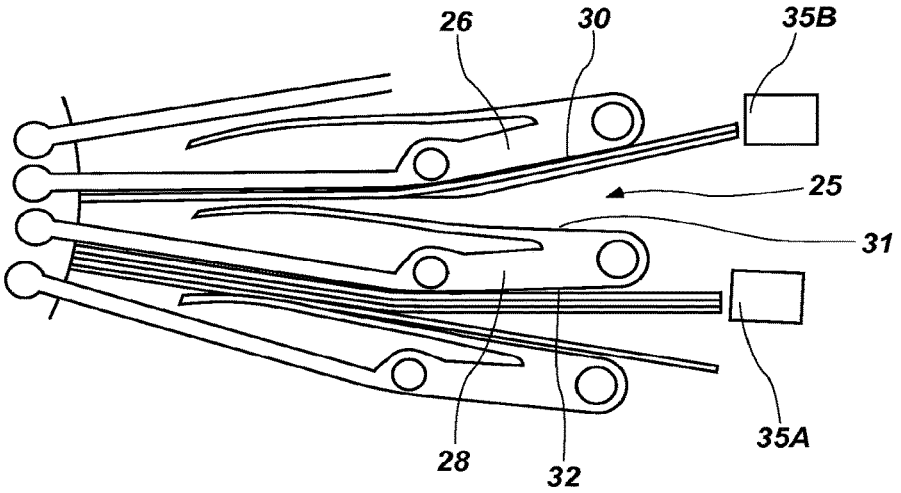
FIG. 3 is an enlarged, partial cross-sectional view of a portion of the shuffling device shown in FIG. 2.

FIG. 3 is an enlarged, partial cross-sectional view of a portion of the shuffling device 12 shown in FIG. 2. Referring to both FIGS. 2 and 3, the fingers 26, 28 may include a beveled edge 30, 32 that enables insertion of playing cards on top of or below existing cards in the compartment 25. When the divider 34 is in the engaged position 40, one or more playing cards in a compartment 25 of the multi-compartment carousel 24 may be displaced relative to the divider 34 to create an opening for insertion of one or more additional playing cards between two playing cards positioned within the same compartment 25 or between one or more playing cards and a portion of the compartment 25. For example, the multi-compartment carousel 24 may be rotated in a direction (e.g., clockwise 42). In some embodiments, the control system 200 (FIG. 5) may cause a stepper motor of the drive system to rotate the multi-compartment carousel 24 the number of steps necessary to create an opening between two selected cards. In other embodiments, once in the engaged position 40, the divider 34 may be translated to create an opening for insertion of one or more additional playing cards.

FIG. 3 further illustrates two examples of implementations of a contact end 35A, 35B of a divider 34 (FIG. 2). As shown in FIG. 3, contact end 35A creates an opening between one or more playing cards and other playing cards in the compartment 25 for insertion of one or more additional playing cards between playing cards already disposed within the compartment 25. By way of further example, contact end 35B creates an opening between one or more playing cards and a surface 31 of the finger 28 that the playing cards are disposed on for insertion of one or more additional playing cards between playing cards already disposed within the compartment 25 and a surface of the compartment on which the playing cards are disposed (e.g., a portion of finger 28 positioned beneath or below the playing cards in the compartment 25 as the playing cards are orientated during loading of the compartment 25).

Referring back to FIG. 2, as can be appreciated from the description above, the shuffling device 12 including the divider 34 may enable insertion of one or more cards into the multi-compartment carousel 24 above all cards currently in the compartment 25, below all cards currently in the compartment 25, and between selected cards already in the compartment 25. Such flexibility in the insertion of playing cards in the shuffling device may enhance the ability of the shuffling device to shuffle (e.g., randomize, sort, etc.) the playing cards that may not be possible with similar shuffling devices such as those mentioned above.

In some embodiments, the divider 34 may be implemented after several playing cards (e.g., two, three, or more playing cards) have already been delivered to one or more of the compartments 25. As the number of playing cards in the compartment 25 increases, the divider 34 increases the number of potential positions of the playing cards within the compartments 25 and may improve shuffling efficiency by enabling each compartment 25 to hold more playing cards by increasing the number of potential positions of each card within the compartments 25. In some embodiments, multiple dividers are provided, one per compartment. In other embodiments, only one divider is provided proximate the infeed rollers 20 (FIG. 2).

In some embodiments, the divider 34 may be movably coupled to a portion of the card handling system 10 (e.g., the shuffling device 12). For example, the divider 34 may be pivotally coupled to a portion of the shuffling device 12 and may rotationally translate between the retracted position 38 and the engaged position 40. In other words, the contact end 35 of the divider 34 may translate along more than one axis (e.g., along the x-axis and y-axis). In other embodiments, the divider 34 may be restrained to a single axis of movement (e.g., along the x-axis). For example, the divider 34 may be slidably coupled to a portion of the shuffling device 12 and may transition the contact end 35 of the divider 34 laterally between the retracted position 38 and the engaged position 40. In such an embodiment, the divider 34 may be moved along the x-axis to engage and disengage one or more cards in a compartment 25. When engaged with the cards, an opening may be formed in the cards in the compartment 25 by rotating the multi-compartment carousel 24 as mentioned above. In yet other embodiments, the contact end 35 of the divider 34 may move along the x-axis and y-axis to both engage and disengage one or more cards in a compartment 25 by moving along the x-axis and to form an opening in the cards in the compartment 25 by moving along the y-axis.

In some embodiments, one or more sensors and, optionally, a controller for receiving signals from the sensors and for controlling a motor 23 (FIG. 5) may also be provided in the card handling system 10. The sensors may be configured to detect a relative position of the multi-compartment carousel 24 so as to enable the control system 200 (FIG. 5) of the card handling system 10 to identify which compartment 25 is aligned to receive a card from the card feed system 20 and which compartment 25 is aligned for ejection of any cards therein by the card transfer system (e.g., a discharge feeder assembly 72 discussed below). For example, the card handling system 10 may include one magnetic sensor that is configured to detect another magnet positioned on the multi-compartment carousel 24.

Figure 3A:
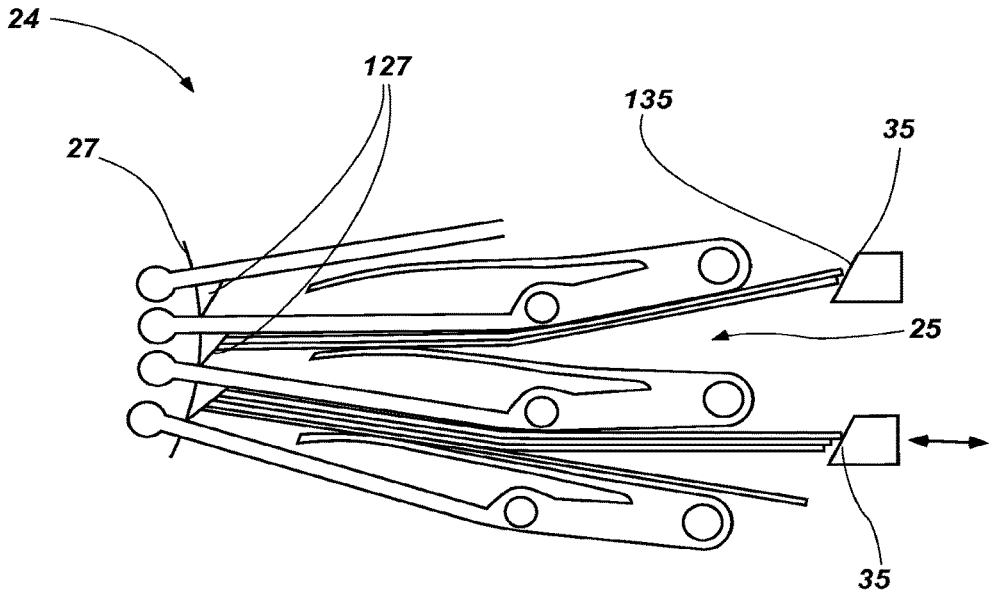
FIG. 3A is an enlarged, partial cross-sectional view of a portion of a shuffling device in accordance with another embodiment of the present disclosure.

In some embodiments and as shown in FIG. 3A, a portion of the multi-compartment carousel 24 may include a surface that provides an offset between at least some of the playing cards (e.g., a lateral offset along the faces of the playing cards) in one or more of the compartments 25 in the multi-compartment carousel 24. For example, an inner portion of the compartments 25 (e.g., a surface of the center member, a surface proximate to the center member 27, or combinations thereof) may comprise an angled surface 127. As playing cards are loaded into the compartment 25, an edge of each of the playing cards will contact a portion of the angled surface 127 providing an offset between at least some of the playing cards. In some embodiments, the angled surface 127 may be orientated such that an edge of a playing card extends from the compartment 25 a distance further than an edge of the playing card on which it is stacked. In other embodiments, a surface of the compartments 25 may be oriented to create an offset opposite to that shown in FIG. 3A or combinations thereof. Such offsets in the playing cards may enable the divider 34 to contact a selected edge of one or more playing cards in the compartments 25. As further shown in FIG. 3A, in some embodiments, the contact end 35 of the divider 34 may also include an angled surface 135 for selectively contacting an edge of one or more playing cards in the compartments 25.

Referring back to FIG. 1, a card pusher 71 may transfer playing cards (e.g., groups of randomized playing cards) from a compartment 25 of the shuffling device 12 and into a card transferring system for transferring groups of playing cards from the shuffling device 12 to the shoe device 14. If the shuffler is delivering only one card to the compartment of the shoe device 14, the card pusher 71 would push only one card. In some embodiments, the card pusher 71 may be similar to the card output devices disclosed in the aforementioned and incorporated by reference U.S. Pat. Nos. 6,659,460 and 7,766,332. The playing cards may move (e.g., under the force of a transport mechanism such as, for example, one or more rollers in a discharge feeder assembly 72) as a set (e.g., one or more playing cards) through an output opening 74 in the shuffling device 12 through the card path 17 in the docking station 16 (if implemented) and then into the shoe device 14 through an opening 84 in a lowermost portion (e.g., base) of the shoe device 14. Stated in another way, the card transferring system may, for example, include one or more mechanisms (e.g., discharge feeder assembly 72, transport mechanism 86) and associated openings in the shuffling device 12 and the shoe device 14 (e.g., openings 74, 84) in order to transfer playing cards from the shuffling device 12 to the shoe device 14 (e.g., without the need for manual intervention). In some embodiments, where the docking station 16 is implemented, the docking station 16 may include a transport mechanism such as, for example, one or more rollers mounted proximate to the card path 17 to force the playing cards along the card path 17 and into the shoe device 14.

A card loading system (e.g., transport mechanism 86 in the base of the shoe device 14) transfers the playing cards into a card storage area 88 of the shoe device 14. In some embodiments, a rotating packer arm 90 may contact a trailing end of the playing cards and force the cards through an aperture 92 in the card storage area 88. The playing cards may be positioned in the card storage area 88 of the shoe device 14 where the playing cards may be advanced to a discharge end 94 of the shoe device 14. For example, a movable card weight 96 may push the playing cards along a lower declining surface of the card storage area 88 in the shoe device 14 toward the discharge end 94 of the shoe device 14. In some embodiments, the movable card weight 96 may be moved by means of gravity or by means of a mechanical force (e.g., one or more springs, a rack and pinion mechanism, etc.).

In some embodiments, the shoe device 14 may include one or more components of a card sensing system 98 similar to the card sensing system 58 discussed above with regard to the shuffling device 12 (e.g., a component or device of a card recognition system such as, for example, a sensor). In some embodiments, card sensing systems 58, 98 may comprise components of a single card sensing system. The card sensing system 98 of the shoe device 14 may be in data communication with the card sensing system 58 of the shuffling device 12. In some embodiments, the shoe device 14 may be in communication (e.g., wirelessly or wired communication) with a control system 200 (FIG. 5) of the shuffling device 12 even when the shoe device 14 is disconnected from the shuffling device 12 (e.g., removed from the alignment pins 18 and, in some embodiments, the docking station 16).

The sensor of the card sensing system 98 in the shoe device 14 may be capable of recognizing the rank and suit of the playing cards. In some embodiments, the card sensing system 98 may (e.g., by sending information to the control system 200 (FIG. 5)) monitor the resulting hands provided by the card handling system 10 to the players. For example, the information of the resulting hands provided from the card handling system 10 may be used to secure a correct payout rate or may be displayed, tracked, or otherwise analyzed. In some embodiments, sensors to sense card location may be used to determine hand composition.

In some embodiments, the information from the sensor 98 may be sent to a portion of the control system 200 (FIG. 5) of the shuffling device 12 and a comparison is performed to confirm all cards exiting the shoe device 14 belong to the original set of playing cards supplied to shuffling device 12. For example, a set file may be generated as playing cards are fed into the shuffling device 12 and are inspected by the sensor of the card sensing system 58 in the shuffling device 12. In a similar manner, data from the card sensing system 58 of the shuffling device 12 may be used to perform a comparison (e.g., by the control system 200) to verify that the playing cards that have exited the shoe device 14 are the same cards that were inputting into the shuffling device 12. In applications that re-use cards, the shoe sensor 98 data can be used to confirm that the cards being inputted into the shuffler are the same. In some embodiments, sensors may detect special markings on the cards, such as, for example, a lot number, a casino identifier, a shoe number, a shift number, a table number, any other known type of special marking, or combinations thereof.

As above, in some embodiments, the card sensing system 98 may comprise one or more of the components disclosed in the aforementioned and incorporated by reference U.S. Patent Application Publication No. US 2007/0018389 A1. In some embodiments, the card sensing systems 58, 98 may include one or more controllers (e.g., an electronic signal processor, such as, for example, a field programmable gate array (FPGA) device) for receiving signals from the sensors (e.g., camera device or line scanning device) to determine rank and/or suit of each card being read or sensed by the card sensing systems 58, 98.

In some embodiments, the card handling system 10 may provide a cut card feature. For example, an upper portion of a shoe device 114 (e.g., a cover 89 over the card storage area 88 of the shoe device 14) may prevent the dealer or players from accessing the playing cards in the card storage area 88 (e.g., the cards may only accessible through the discharge end 94 of the shoe device 14 and may prevent the insertion of a cut card). The card handling system 10 may enable a cut card to be fed into the shoe device 14 by the shuffling device 12. For example, a cut card may be inserted into the card input area 22 and fed into the card handling system 10. In some embodiments, the card sensing system 58 may identify the cut card and place it in a predetermined location (e.g., into a selected compartment 25 of the multi-compartment carousel 24). The shuffling device 12 may load the cut card into the shoe device 12 in a predetermined position (e.g., the four hundredth card out of four hundred sixteen cards in a set of eight decks). When the cut card is removed from the shoe device 14 (e.g., by the dealer), the cut card may indicate to cease outputting cards from the supply contained the shoe device 12. In some embodiments, the cut card may be inserted by the shuffling device 12 after the shoe device 14 has been loaded. For example, the cut card may be inserted by the shuffling device 12 during unloading of the shoe device 14. By way of further example, after a predetermined number of cards have been dealt from the shoe device 14, the cut card 12 may be provided from the shuffling device 12.

Figure 4:
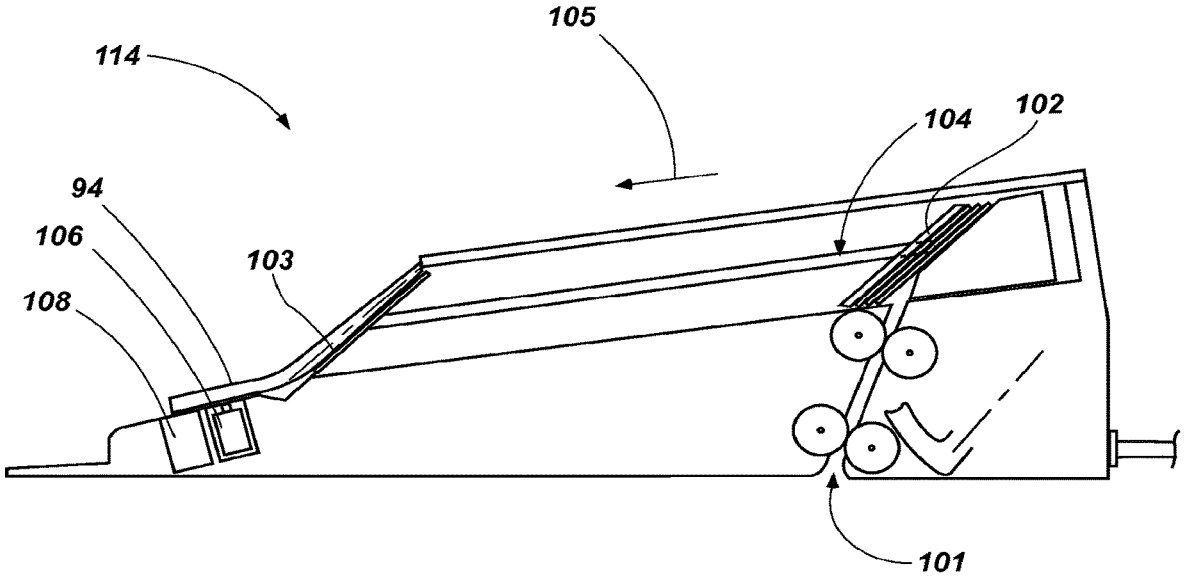
FIG. 4 is a partial cross-sectional view of a shoe device that may be used in embodiments of card handling systems of the present disclosure, such as the card handling systems shown in FIGS. 1 and 1A.

FIG. 4 is a partial cross-sectional view of another embodiment of a shoe device 114. As shown in FIG. 4, the shoe device 114 may include an opening 101 formed in a base of the shoe device 114 such as, for example, a portion of the shoe device 114 resting on an adjacent structure (e.g., the gaming table 11, the shuffling device 12, docking station 16, etc.). The opening 101 is positioned to receive playing cards from another portion of the card handling system 10 (e.g., the shuffling device 12, the docking station 16). The shoe device 114 may include a movable support plate 103 that is movable along a slot 104 in the sides of the shoe device 114. The plate 103 may be moved into a loading position 102 when the shoe is empty, and advances in a direction shown by arrows 105 toward the discharge end of the shoe device 114 along the slot 104 until reaching a final position 103 when the playing card inventory in the shoe device 114 has been exhausted. The support plate 103 aligns cards being loaded and prevents the cards from falling down and blocking the infeed aperture.

In some embodiments, the shoe device 114 may include a card blocking feature that enables the shoe device 114 (e.g., the control system 200 (FIG. 5) of the shoe device 114) to prevent cards from being removed or inserted into the shoe device 114 during selected times (e.g., as defined by the rules of game play). For example, the shoe device 114 may include a barrier feature 106 that may selectively position a barrier in the card path (e.g., at the discharge end 94 of the shoe device 114) to prevent cards from being discharged from or inadvertently reinserted into the shoe device 114. In some embodiments, the barrier feature 106 may be movable (e.g., automatically movable by the control system 200) to a blocking position where cards may not be discharged from or inserted into the exit end of the shoe device 114 and to a retracted position where cards may be discharged from the shoe device 114. For example, the barrier feature 106 may, on a command from the control system 200, move (e.g., actuate the barrier by the use of an actuator such as, for example, a solenoid) a barrier from the retracted position to the blocking position to prevent cards from being discharged from or reinserted into the shoe device 114. The barrier feature 106 may also, on a command from the control system 200, move the barrier (e.g., actuate the barrier) from the blocking position to the retracted position to enable cards to be discharged from the shoe device 114. In some embodiments, the barrier feature 106 may be moved between the retracted position and the blocking position by one or more single direction solenoids or by a duel- or multi-direction solenoid. In some embodiments, the barrier feature 106 may be biased in one position (e.g., the retracted or the blocking position). For example, the barrier feature 106 may be biased in the retracted position (e.g., by a spring, a gravitational force, etc.) and may include a solenoid to move the barrier to and hold the barrier in the blocking position. Once the force from the solenoid is released, a biasing element may return the barrier feature 106 to the retracted position.

In some embodiments, the shoe device 114 may include a masking device 108 that at least partially conceals at least one indication of the movement of the barrier feature 106 (e.g., a sound produced by the movement of a portion of the barrier feature 106) between the retracted and blocking positions. For example, the masking device 108 may disguise the movement of the barrier feature 106 by creating an output similar to that of the barrier feature 106 during movement. By way of further example, the masking device 108 may include another solenoid that moves independently of the barrier feature 106 such that external indications of movement of the barrier feature 106 and the masking device 108 are substantially indiscernible.

It is noted that the shoe devices 14, 114 of FIGS. 1 and 4 are shown as having one of the card sensing system 98 and the barrier feature 106 for the sake of clarity in the drawings. In some embodiments, the shoe devices 14, 114 may include one or both of the card sensing systems 98 and the barrier feature 106.

It is further noted that, while the two-dimensional representations of the card handling system 10 presented herein may give an impression that components of the card handling system 10 (e.g., rollers of the card feed system 20, the divider 34, the packer arm device 36, the rotating packer arm 90, etc.) are disposed in the same plane, the components of the shuffler device 12 may be offset from one another. For example, as shown in FIG. 2, the divider 34 may be laterally offset from the rollers of the card feed system 20 and the packer arm device 36 such that the divider 34 may contact the playing cards without interference from the card feed system 20 and the packer arm device 36.

Figure 5:
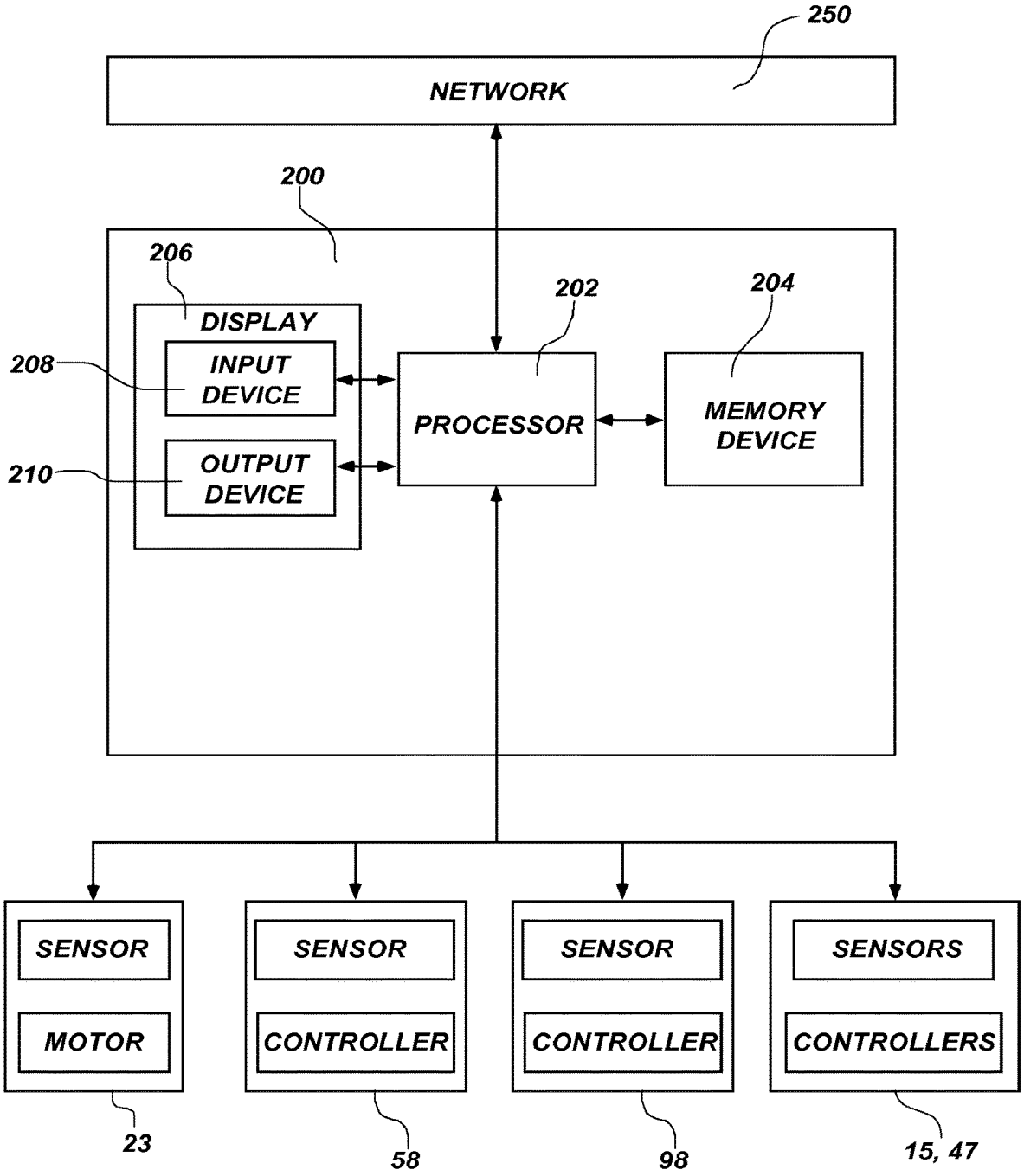
FIG. 5 is a schematic diagram of a control system that may be used in embodiments of card handling systems of the present disclosure, such as that shown in FIGS. 1 and 1A.

FIG. 5 is a schematic diagram of a control system that may be used in embodiments of card handling systems of the present disclosure, such as that shown in FIG. 1. As shown in FIG. 5, the card handling system 10 may include a control system 200 for control of the various components of the card handling system 10 such as those discussed herein. The control system 200 may be configured to receive input signals from a user (e.g., through a display 206 and input device 208), to receive input signals from one or more of the various sensors described herein, and/or for selectively controlling one or more of the various previously described active components of the card handling device 10.

In some embodiments, the entire control system 200 may be physically located within the card handling system 10. In other words, the control system 200 may be integrated into or with the components of the card handling system 10 such as, for example, the shuffling device 12 and the shoe device 14. In other embodiments, one or more components of the control system 200 may be physically located outside the card handling system 10. Such components may include, for example, a computer device (e.g., a desktop computer, a laptop computer, a handheld computer, personal data assistant (PDA), network server, etc.). Such external components may be configured to perform functions such as, for example, image processing, bonus system management, network communication and the like.

The control system 200 may include at least one electronic signal processor 202 (e.g., a microprocessor). The control system 200 also may include at least one memory device 204 for storing data to be read by the electronic signal processor 202 and/or for storing data sent to the at least one memory device 204 by the electronic signal processor 202. The control system 200 also may include one or more displays 206, one or more input devices 208, and one or more output devices 210. By way of example and not limitation, the one or more input devices 208 may include a keypad, a keyboard, a touchpad, a button, a switch, a lever, a touch screen, pressure sensitive pads, etc., and the one or more output devices 210 may include a graphical display device (e.g., a screen or monitor), a printer, one or more light emitting diodes (LEDs), a device for emitting an audible signal, etc. In some embodiments, the input device 208 and the output device 210 may be integrated into a single unitary structure (e.g., the display 206).

The control system 200 may be configured to communicate electrically with each of the previously described card sensing systems 58, 98 (e.g., sensors and controllers, if implemented, for receiving signals from the sensors of the card sensing systems 58, 98), sensors 15 for indicating attachment of the shoe device 14, 114 (FIGS. 1 and 4), sensors 47 for indicating the position of the magazine 44 (FIG. 1), and sensors 23 for controlling the motor of the multi-compartment carousel 24 (FIG. 1).

In some embodiments, the card handling system 10 may be incorporated into a table game management system by connecting or otherwise providing communication between the control system 200 of the card handling system 10 and a network 250. For example, a data port (not shown) on the card handling system 10 may be used to provide electrical communication to the network 250 through a conductive wire, cable, or wireless connection. The network 250 may communicate with the electronic signal processor 202 of the control system 200. In additional embodiments, the network 250 may communicate directly with one or more controllers of the card sensing systems 58, 98, or with both the electronic signal processor 202 of the control system 200 and the controllers of the card sensing systems 58, 98.

Embodiments of the present disclosure may also be particularly useful in providing a card handling system for a casino table game such as, for example, Baccarat, that provides a closed process between the feed or input of the un-shuffled cards and the output of the cards for use in the game. As card handling systems of the present disclosure offer a system where no manual interaction is generally necessary between the input and the output of the cards, security measures generally provided with a set of playing cards may be reduced as the card handling system may verify that one or more decks of playing cards (e.g., complete and untampered decks) are provided to the input of the card handling system and, subsequently, shuffled and transferred to the shoe for output to players of the game. Such card handling systems may enable security measures for playing cards with regards to, for example, production, delivery, storage, distribution, shuffling, and the transfer from a shuffler to a shoe. Security issues created by handling cards between the shuffler and shoe can also be reduced or eliminated. Also, systems of the present disclosure prevent alteration of or tampering with the cards after shuffling and before card delivery increasing card security.

Embodiments of the present disclosure may be particularly useful in providing a card handling system that may be mounted to a gaming table or other surface such that a majority of the shuffling device of the card handling system is disposed in an area that is less obstructive to a casino game being played with cards supplied from the card handling system, such as underneath a gaming table. The card handling system may also enable attachment of portions of the card handling system to a gaming table without the need for cutting a hole in or otherwise altering the gaming table. Further, a portion of the card handling system such as the shuffling device may be interchangeably used with multiple shoe devices as one or more shoes may be connected to and subsequently removed from the card handling system. In one embodiment, the shoe may be removed from the docking station or otherwise disconnected from the shuffler to enable the dealer to move the shoe during use on the table. Finally, the card handling system may enable enhanced shuffling ability of the card handling system through components such as the divider of the shuffling device that enable insertion of playing cards into the shuffling device that may not be possible with similar shuffling devices.

Additional non-limiting example Embodiments are described below.

Embodiment 1

A card handling system, comprising: a shuffling device comprising a first card sensing device; a shoe device comprising a second card sensing device; a card transfer system for transferring cards directly from the shuffling device into the shoe device; and a processor for controlling operation of the system.

Embodiment 2

The system of Embodiment 1, wherein the card transfer system is configured to automatically transfer cards from the shuffling device into a card storage area of the shoe device.

Embodiment 3

The system of Embodiment 2, further comprising a card infeed area in the shuffling device, the card infeed area configured to supply cards into the shuffling device through a card feed system including the second card sensing device.

Embodiment 4

The system of Embodiment 3, wherein the card infeed area comprises a rotatable magazine.

Embodiment 5

The system of any one of Embodiments 1 through 4, wherein the shoe device is separable from the shuffling device.

Embodiment 6

The system of Embodiment 5, wherein the shuffling device is configured to be interchangeably used with a plurality of shoe devices.

Embodiment 7

The system of any one of Embodiments 1 through 6, wherein the card transfer system is positioned adjacent to a side portion of a gaming table.

Embodiment 8

The system of Embodiment 7, wherein the shoe device is configured to be disposed on a playing surface of a gaming table and wherein the shuffling device is configured to be disposed external to a playing surface of a gaming table.

Embodiment 9

The system of Embodiment 8, further comprising a docking station comprising at least one mounting device configured to receive the shoe device thereon.

Embodiment 10

The system of Embodiment 9, wherein the shoe device is removably mounted to the docking station.

Embodiment 11

A shuffling device, comprising: a card infeed area; a first card feed mechanism for transporting cards from the card infeed area to a carousel comprising a plurality of compartments; and a divider positioned proximate to the carousel and operable to contact at least one card positioned within at least one compartment of the plurality of compartments of the carousel.

Embodiment 12

The shuffling device of Embodiment 11, further comprising a processor for controlling the operation of the shuffling device, including translation of the divider relative to the carousel after the divider contacts the at least one card to create an opening between at least one of the at least one card and at least another card within the at least one compartment of the plurality of compartments and the at least one card and a surface of the carousel forming a portion of the at least one compartment of the plurality of compartments.

Embodiment 13

The shuffling device of Embodiment 12, wherein the processor initiates a rotation of the carousel to create the opening.

Embodiment 14

The shuffling device of Embodiments 12 or 13, wherein the divider is movable between a retracted position and an engaged position, the divider being separated from the at least one card in the retracted position and in contact with the at least one card in the engaged position.

Embodiment 15

A shoe device, comprising: a card storage area; and a card loading system for loading cards into the card storage area through an opening in a base of the shoe device, the card loading system comprising at least one set of transport rollers.

Embodiment 16

The shoe device of Embodiment 15, wherein the card loading system is positioned to receive cards through the base of the shoe device from a shuffling device.

Embodiment 17

A method of providing cards during a casino table game play, the method comprising: loading cards into a shuffling device positioned at least partially below a playing surface of a gaming table; obtaining card information including a rank and a suit of each card as the card moves through the shuffling device; shuffling the loaded cards; transporting the card from the shuffling device to a removable shoe device positioned over a playing surface of a gaming table; obtaining card information including a rank and a suit of each card as the card moves through the shoe device; and supplying the card through a card output area of the shoe device.

Embodiment 18

The method of Embodiment 17, further comprising comparing the card information obtained in the shoe device with the card information obtained in the shuffling device.

Embodiment 19

The method of Embodiments 17 or 18, wherein shuffling the loaded cards comprises: loading at least one card into at least one compartment of a carousel comprising a plurality of compartments; creating an opening with a divider between at least one of the at least one card and at least another card within the at least one compartment and the at least one card and a surface of the carousel forming a portion of the at least one compartment; and loading at least another card into the opening.

Embodiment 20

The method of any one of Embodiments 17 through 19, further comprising removably positioning the shoe device over a portion of the shuffling device.

Embodiment 21

The method of Embodiment 20, further comprising aligning the shoe device with at least one mounting device provided over the shuffling device.

Although the foregoing description contains many specifics, these are not to be construed as limiting the scope of the present disclosure, but merely as providing certain exemplary embodiments. Similarly, other embodiments of the disclosure may be devised that do not depart from the scope of the present disclosure. For example, features described herein with reference to one embodiment also may be provided in others of the embodiments described herein. The scope of the disclosure is, therefore, indicated and limited only by the appended claims and their legal equivalents, rather than by the foregoing description. All additions, deletions, and modifications to the disclosure, as disclosed herein, which fall within the meaning and scope of the claims, are encompassed by the present disclosure.

What is claimed is:

1. A method of providing cards during casino table game play, the method comprising:

receiving, with a card-handling system, cards into a shuffling device of the card-handling system positioned at least partially below a playing surface of a gaming table;

obtaining, with at least one card sensing device of the card-handling system, card information including a rank and a suit of each card of the cards as the card moves through the shuffling device;

shuffling the loaded cards with the shuffling device;

transporting, with the card-handling system, the cards from the shuffling device to a shoe device positioned over a playing surface of a gaming table;

obtaining, with the at least one card sensing device of the card-handling system, card information including a rank and a suit of each card as the card moves through the shoe device; and supplying, with the card-handling system, the card to a card output area of the shoe device.

2. The method of claim 1, further comprising comparing the card information obtained in the shoe device with the card information obtained in the shuffling device.

3. The method of claim 1, wherein shuffling the loaded cards comprises:

loading at least one card of the cards into at least one compartment of a carousel comprising a plurality of compartments;

creating an opening with a divider between at least one of the at least one card and at least another card within the at least one compartment or the at least one card and a surface of the carousel forming a portion of the at least one compartment; and loading at least another card into the opening.

4. The method of claim 1, further comprising removably positioning the shoe device over a portion of the shuffling device.

5. The method of claim 4, further comprising aligning the shoe device with at least one mounting device provided over the shuffling device.

6. The method of claim 1, further comprising moving the cards through a slot extending through a bottom surface of the shoe device.

7. A method of operating a card handling device and a shoe device of a card handling system, the method comprising:

receiving cards into the card handling device of the card handling system;

transporting the cards from the card handling device to a shoe device of the card handling system through an opening in a bottom portion of the shoe device with at least one roller of the card handling system; and supplying at least one card of the cards to a card output area of the shoe device with the shoe device.

8. The method of claim 7, further comprising shuffling the cards with the card handling device.

9. The method of claim 7, further comprising positioning the card handling device at least partially below a playing surface of a gaming table.

10. The method of claim 7, further comprising obtaining card information including at least one indicia of each card of the cards as the card moves through the card handling device with a first card sensing device.

11. The method of claim 7, further comprising obtaining card information including at least one indicia of each card of the cards as the card moves through the shoe device with a second card sensing device.

12. The method of claim 11, further comprising comparing the card information obtained in the shoe device with the card information obtained in the card handling device with a processor of the card handling system.

13. The method of claim 7, further comprising removably positioning the shoe device over a portion of the card handling device.

14. The method of claim 13, further comprising aligning the shoe device with at least one mounting device provided over the card handling device.

15. The method of claim 7, further comprising automatically transferring cards from the card handling device into a card storage area of the shoe device with the card handling system.

16. The method of claim 7, further comprising interchangeably using the card handling device with a plurality of shoe devices.

17. The method of claim 16, further comprising:

positioning at least one shoe device of the plurality of shoe devices on a playing surface of a gaming table; and positioning the card handling device external to the playing surface of the gaming table.

18. The method of claim 17, further comprising separating the shoe device from the card handling device after the cards are loaded into the shoe device.

19. The method of claim 18, further comprising dealing the cards from the shoe device after separating the shoe device from the card handling device.

20. A method of operating card-handling devices of a card-handling system, the method comprising:

receiving, with the card-handling system, cards into a shuffling device of the card-handling system, the shuffling device positioned at least partially below a playing surface of a gaming table;

shuffling the loaded cards with the shuffling device;

transporting the cards from the shuffling device to a shoe device positioned proximate the playing surface of the gaming table with at least one of the shuffling device or the shoe device of the card-handling system; and supplying, with the card-handling system, the cards to a card output area of the shoe device.

* * * * *